US012281423B2

(12) United States Patent
Egami et al.

(10) Patent No.: US 12,281,423 B2
(45) Date of Patent: Apr. 22, 2025

(54) ROTARY HOOK CONSTRUCTION FOR SEWING MACHINE AND SEWING MACHINE

(71) Applicant: TISM CO., LTD., Kasugai (JP)

(72) Inventors: Shinko Egami, Kasugai (JP); Takahiro Yoshida, Kasugai (JP); Tatsuya Yamashita, Kasugai (JP)

(73) Assignee: TISM CO., LTD., Kasugai (JP)

( * ) Notice: Subject to any disclaimer, the term of this patent is extended or adjusted under 35 U.S.C. 154(b) by 0 days.

(21) Appl. No.: 18/694,520

(22) PCT Filed: Mar. 16, 2022

(86) PCT No.: PCT/JP2022/011963
§ 371 (c)(1),
(2) Date: Mar. 22, 2024

(87) PCT Pub. No.: WO2023/053507
PCT Pub. Date: Apr. 6, 2023

(65) Prior Publication Data

US 2024/0392485 A1 Nov. 28, 2024

(30) Foreign Application Priority Data

Sep. 30, 2021 (JP) ..... 2021-161556

(51) Int. Cl.
*D05B 57/14* (2006.01)
*D05B 57/26* (2006.01)

(52) U.S. Cl.
CPC ..... *D05B 57/14* (2013.01); *D05B 57/26* (2013.01)

(58) Field of Classification Search
CPC ..... D05B 57/14; D05B 57/26; D05B 57/143; D05B 57/265
See application file for complete search history.

(56) References Cited

U.S. PATENT DOCUMENTS 2,244,876 A * 6/1941 Frampton ..... D05B 15/04 112/233
2,657,658 A * 11/1953 Johnson ..... D05B 57/14 112/228

(Continued)

FOREIGN PATENT DOCUMENTS

JP S4121708 Y 10/1966
JP S63171180 U 11/1988

(Continued)

OTHER PUBLICATIONS

International Search Report issued in Intl. Appln. No. PCT/JP2022/011961 mailed May 17, 2022. English translation provided.

(Continued)

*Primary Examiner* — Ismael Izaguirre
(74) *Attorney, Agent, or Firm* — ROSSI, KIMMS & McDOWELL LLP

(57) ABSTRACT

A rotary hook includes a bobbin case housing a lower thread bobbin, an inner rotary hook and an outer rotary hook. A needle drop hole is provided in an upper front surface of the inner rotary hook, and a recess is formed therein at a position deviated from the needle drop hole in a rotating direction of the outer rotary hook. The recess opens forward and upward and has a rear wall. The bobbin case provides with a thread take-up member for directing a lower thread, paid out from the lower thread bobbin, toward the recess. The lower thread paid out from the lower thread bobbin is passed through the recess via the thread take-up member and then directed to a needle hole of a needle plate provided above. With this arrangement, it is possible to structurally avoid occurrence of a hitch stitch caused by the lower thread.

13 Claims, 12 Drawing Sheets

(56) References Cited

U.S. PATENT DOCUMENTS

| | | | | | |
|---|---|---|---|---|---|
| 3,083,659 | A * | 4/1963 | Kuhar | D05B 57/14 112/228 |
| 3,343,510 | A * | 9/1967 | Attwood | D05B 57/14 112/196 |
| 3,921,551 | A * | 11/1975 | Gustmann | D05B 57/14 112/181 |
| 4,434,734 | A * | 3/1984 | Russell | D05B 57/26 112/229 |
| 4,787,326 | A | 11/1988 | Scholl et al. | |
| 5,651,323 | A * | 7/1997 | Hirose | D05B 57/16 112/231 |
| 6,799,527 | B2 * | 10/2004 | Kato | D05B 57/14 112/228 |

FOREIGN PATENT DOCUMENTS

| | | | |
|---|---|---|---|
| JP | H0268096 | A | 3/1990 |
| JP | H0675375 | U | 10/1994 |
| JP | H06343780 | A | 12/1994 |
| JP | 2515400 | B2 | 7/1996 |
| JP | 2540051 | B2 | 10/1996 |
| JP | H08257275 | A | 10/1996 |
| JP | 2006239389 | A | 9/2006 |
| JP | 2008023261 | A | 2/2008 |
| JP | 2008086391 | A | 4/2008 |
| JP | 2012029801 | A | 2/2012 |
| JP | 2012213603 | A | 11/2012 |
| JP | 2020137624 | A | 9/2020 |

OTHER PUBLICATIONS

Written Opinion issued in Intl. Appln. No. PCT/JP2022/011961 mailed May 17, 2022.

International Search Report issued in Intl. Appln. No. PCT/JP2022/011962 mailed May 31, 2022. English translation provided.

Written Opinion issued in Intl. Appln. No. PCT/JP2022/011962 mailed May 31, 2022.

International Search Report issued in Intl. Appln. No. PCT/JP2022/011963 mailed Jun. 7, 2022. English translation provided.

Written Opinion issued in Intl. Appln. No. PCT/JP2022/011963 mailed Jun. 7, 2022.

International Search Report issued in Intl. Appln. No. PCT/JP2022/011964 mailed May 17, 2022. English translation provided.

Written Opinion issued in Intl. Appln. No. PCT/JP2022/011964 mailed May 17, 2022.

Egami et al. Copending U.S. Appl. No. 18/694,495, filed Mar. 22, 2024.

Egami et al. Copending U.S. Appl. No. 18/694,513, filed Mar. 22, 2024.

Egami et al. Copending U.S. Appl. No. 18/694,532, filed Mar. 22, 2024.

* cited by examiner

ROTARY HOOK CONSTRUCTION FOR SEWING MACHINE AND SEWING MACHINE

TECHNICAL FIELD

The present invention relates to a rotary hook construction for a sewing machine constructed to be able to avoid occurrence of a hitch stitch in forming stitches on a sewing workpiece and also relates to a sewing machine comprising the rotary hook construction.

BACKGROUND

There have heretofore been known sewing machines which are provided with: a sewing mechanism that performs sewing on a sewing workpiece (such as a fabric workpiece) by moving vertically or up and down a sewing needle with an upper thread passed therethrough, and rotating a rotary hook, having a lower thread housed therein, in synchronism with the vertical or up-and-down movement of the sewing needle to thereby entwine the upper thread around the lower thread; and a feed mechanism that moves a frame (or holding member), having the sewing workpiece held thereon, relative to a needle drop position, to thereby form a stitch in a desired direction on the sewing workpiece. Such sewing machines can form stitches of various lengths in various directions by performing movement control of the sewing workpiece via the feed mechanism on a stitch-by-stitch basis.

It is known in the art that stitches formed by the sewing machines of the aforementioned type come in different quality, namely perfect stitch quality and hitch stitch quality. The perfect stitch is a stitch formed by entwining an upper thread and a lower thread with each other in a mutually balanced state, while the hitch stitch is a stitch formed by entwining an upper thread and a lower thread with each other in such a manner that only the upper thread draws a spiral shape. It is also known that whether the stitch is formed in the perfect stitch quality or in the hitch stitch quality depends mainly on two factors or causes. The first one of the two factors is behavior of the upper thread; more specifically, in this case, the perfect stitch or the hitch stitch is formed depending on in which of counterclockwise and clockwise directions the upper thread, extending through an eye hole of the sewing needle in a front-to-rear direction to connect to the fabric workpiece when the sewing needle with the upper thread passed therethrough pierces the fabric workpiece, is entwined around the sewing needle in accordance with a moving direction of the fabric workpiece (i.e., stitch forming direction) at the time of stitch formation. It is also known that the hitch stitch is formed by the upper thread being entwined around the sewing needle in the clockwise direction.

Note that throughout this description, the term "front" ("in front of", "forward", "front side", and the like) and the term "rear" ("behind", "rearward", "rear side", and the like) respectively refer to the front and rear (back) of the sewing machine as viewed from the front (or in front view) of the sewing machine, the term "left" and "right" respectively refer to the left and right of the sewing machine as viewed from the front (or in front view) of the sewing machine, and the term "leftward twining direction" and "rightward twining direction" respectively refer to counterclockwise and clockwise directions as viewed in top plan view of the sewing machine.

The second one of the two factors is behavior of the lower thread; more specifically, in this case, the perfect stitch or the hitch stitch is formed depending on a relationship between a path of the lower thread—extending from the rotary hook (lower thread bobbin), provided beneath a needle plate, and passing through a needle hole of the needle plate to connect to the working fabric located above the needle plate—and the needle drop position of the sewing needle. Namely, it is known that the hitch stitch is formed when the path of the lower thread is located to the right of an up-down movement trajectory of the sewing needle (needle drop position) in accordance with the moving direction of the fabric workpiece (stitch forming direction) at the time of stitch formation.

The hitch stitch is undesirable in that it not only looks unattractive as compared to the perfect stitch but also degrades sewing quality (involving, for example, a problem that the stitch easily gets loosened). Thus, there have been proposed a variety of approaches for avoiding occurrence of a hitch stitch. According to one example of such proposed approaches, a determination is made, per stitch to be formed, as to whether the moving direction of the fabric workpiece (i.e., stitch forming direction) is a perfect-stitch forming direction or a hitch-stitch forming (or occurring) direction, and upon determination that the moving direction of the fabric workpiece (stitch forming direction) is the hitch-stitch forming direction, the position of the upper thread or the lower thread relative to the needle drop position is changed by moving the frame or using a given operating piece.

Patent Literature 1 identified below discloses an invention constructed to avoid occurrence of a hitch stitch due to the behavior of the upper thread. According to the invention described in Patent Literature 1, upon determination that the moving direction of the frame holding the fabric workpiece (i.e., stitch forming direction) is a hitch-stitch forming direction in which a hitch stitch is undesirably formed due to the behavior of the upper thread, the frame is caused to detour leftward of the sewing needle and then move to a target needle drop position (target position) for stitch formation before the tip end of the descending sewing needle reaches the upper surface of the fabric workpiece, instead of the frame being moved directly to the target position. Namely, the invention described in Patent Literature 1 intends to avoid occurrence of a hitch stitch due to the behavior of the upper thread, by entwining the upper thread, connecting to the fabric workpiece, counterclockwise around the sewing needle. However, in order to quickly entwine the upper thread counterclockwise around the sewing needle by causing the frame to detour during the descending movement of the sewing needle, this invention requires an exact match between the time of the descending movement of the sewing needle and the time of the detouring movement of the frame. Thus, if there is any time mismatch between the descending movement of the sewing needle and the detouring movement of the frame, this prior art presents a problem of failing to entwine the upper thread around the sewing needle. Therefore, with the technique described in Patent Literature 1, it is difficult to reliably avoid occurrence of a hitch stitch.

Patent Literature 2 identified below discloses an invention constructed to avoid occurrence of a hitch stitch due to behavior of the lower thread. According to the invention described in Patent Literature 2, a recessed portion is formed behind the needle hole of the needle plate in communication with the needle hole, and upon determination that the moving direction of the frame holding the fabric workpiece (i.e., stitch forming direction) is a hitch-stitch forming direction in which a hitch stitch is undesirably formed due to the behavior of the lower thread, the frame is caused to detour along the shape of the recessed portion and then moved to a target needle drop position for stitch formation (target position), instead of the frame being moved directly to the target position. More specifically, the recessed portion has a distal end portion extending in a left-to-right direction. The frame is moved to detour such that the lower thread enters the distal end portion of the recessed portion from the left of the distal end portion to be engaged in the distal end portion, and that the path of the lower thread passes by the left of the needle drop position and is then stopped behind the needle drop position (i.e., such that the sewing needle drops at a position located to the right and in front of the path of the lower thread). Namely, the invention described in Patent Literature 2 intends to avoid occurrence of a hitch stitch due to the behavior of the lower thread by causing the sewing needle to drop at a position located to the right of the path of the lower thread extending upward to connect to the fabric workpiece. However, because the recessed portion formed behind the needle hole in communication with the needle hole has the distal end portion extending in the left-to-right direction, a protrusion (so-called "peninsular portion") extending in a right-to-left direction is inevitably formed between the distal end portion and the needle hole. Due to the presence of such a protrusion, this prior art may present a problem of causing an unwanted breakage of the upper thread.

As also known in the art, an upper thread loop captured by a hook point of an outer rotary hook is caused to move while slipping between the outer rotary hook and an inner rotary hook and is then lifted up by a thread take-up lever to move upward along the lower thread while twining around the lower thread. With the construction described in Patent Literature 2, however, the upper thread loop moving upward along the lower thread may undesirably get caught on the protrusion (peninsular portion) adjoining the distal end portion of the recessed portion having the lower thread engaged therein, in which case the upper thread may be undesirably cut or broken. Further, because the lower thread is engaged by entering the distal end portion of the recessed portion, there may be encountered a problem that the lower thread remains engaged in the recessed portion depending on the stitching direction of the next stitch and thus takes a lower thread path different from the normal path.

Patent Literature 3 identified below, too, discloses an invention constructed to avoid occurrence of a hitch stitch due to behavior of the lower thread. According to the invention described in Patent Literature 3, a switch mechanism is provided for switching the path of the lower thread, leading to the needle hole of the needle plate after getting out of the rotary hook, between a left-side route for deviating the path to the left of the up-down movement trajectory of the sewing needle and a right-side route for deviating the path to the right of the up-down movement trajectory. Such lower thread path switching by the switch mechanism is performed through driving of an air cylinder. Upon determination that the moving direction of the frame holding the fabric workpiece (i.e., stitch forming direction) is a direction in which a hitch stitch is formed due to the behavior of the lower thread, the switch mechanism switches the path of the lower thread to either the left-side route or the right-side route before the tip end of the descending sewing needle reaches the upper surface of the fabric workpiece, thereby avoiding occurrence of a hitch stitch. However, the invention described in Patent Literature 3 presents a problem that the construction is complicated, because it is necessary to provide the air-cylinder-driven switch mechanism.

Further, Patent Literature 4 identified below discloses an invention constructed to avoid occurrence of hitch stitches due to behavior of the upper thread and the lower thread. The invention described in Patent Literature 4 includes upper thread control means (needle bar pivoting mechanism) that controls a relationship of the upper thread with the sewing needle and lower thread control means (thread drawing mechanism) that controls a relationship of the lower thread with the sewing needle. With such arrangements, this prior art avoids occurrence of hitch stitches by controlling the individual control means in accordance with the moving direction of the fabric workpiece. Because the needle bar pivoting mechanism as the upper thread control means and the thread drawing mechanism as the lower thread control means each have a complicated construction, this prior art presents a problem that the overall construction of the sewing machine is complicated. Furthermore, in a multi-needle sewing machine where one machine head has a plurality of needle bars, such a complicated construction becomes an even more serious problem.

Furthermore, Patent Literature 5 identified below discloses a sewing machine capable of sewing by individually turning a machine head and a rotary hook housing section. This prior art sewing machine is constructed to achieve enhanced sewing quality by appropriately synchronizing the respective operations of the sewing needle and the rotary hook and respective turning of the machine head and rotary hook housing section. However, this sewing machine presents a problem that the construction is complicated because it has to include a mechanism for turning the machine head and the rotary hook housing section and means for synchronizing the respective operations of these components. The construction described in Patent Literature 5 may be suited for linearly sewing in a given direction, such as sewing running stitches; however, with the construction described in Patent Literature 5, synchronization control is very difficult to perform in the case of embroideries, such as a satin stitch embroidery, where the stitching direction may be reversed, because the turning directions of the machine head and the rotary hook housing section have to be reversed stitch by stitch and the stitching direction, too, changes.

PRIOR ART LITERATURE

Patent Literature

Patent Literature 1: Japanese Patent No. 2515400
Patent Literature 2: Japanese Patent Application Laid-open Publication No. HEI-6-343780
Patent Literature 3: Japanese Patent Application Laid-open Publication No. 2008-23261
Patent Literature 4: Japanese Patent Application Laid-open Publication No. 2012-213603
Patent Literature 5: Japanese Patent No. 2540051

SUMMARY

In view of the foregoing prior art problems, it is one of the objects of the present invention to provide a rotary hook construction for a sewing machine that is configured to be able to avoid occurrence of a hitch stitch and to provide a sewing machine having such a rotary hook construction.

According to a first aspect, the present invention provides a rotary hook construction suited for avoiding occurrence of a hitch stitch due to behavior of a lower thread. To accomplish this object, the rotary hook construction for the sewing machine of the present invention includes a bobbin case rotatably housing a lower thread bobbin having the lower thread wound thereon, an inner rotary hook housing the bobbin case, and an outer rotary hook that rotates around the inner rotary hook in synchronism with an up-and-down movement of a sewing needle, the inner rotary hook having a needle drop hole formed in an upper front surface portion thereof. The rotary hook construction of the present invention is characterized in that the inner rotary hook has a recessed portion formed in the upper front surface portion and at a position deviated from the needle drop hole in a rotating direction of the outer rotary hook, the recessed portion opening forward and upward and downward and having a rear wall surface, and that the bobbin case has a thread take-up member provided thereon for directing the lower thread, paid out from the lower thread bobbin, toward the recessed portion of the inner rotary hook, wherein the lower thread paid out from the lower thread bobbin within the bobbin case is pulled out upward after passing through a hollow space of the recessed portion by way of the thread take-up member.

The rotating direction of the outer rotary hook is a direction in which a loop of the upper thread is captured (hooked) by a hook point of the rotating outer rotary hook within the rotary hook. Because the rotating direction of the outer rotary hook is usually the counterclockwise direction, a moving direction of the hook point of the outer rotary hook at the time of capturing the upper thread loop is counterclockwise; such a counterclockwise moving direction of the kook point can be said to be leftward as viewed from the front of the sewing machine. In such a case, the recessed portion is formed at a position deviated leftward from a trajectory of the up-and-down movement of the sewing needle (i.e., deviated from the trajectory substantially in the rotating direction of the outer rotary hook).

As known in the art, in the sewing machine, a holding member (i.e., sewing frame or embroidery frame) for holding a sewing workpiece is disposed above a needle plate and caused to move in a desired direction stitch by stitch to thereby cause a stitch to be formed on the sewing workpiece in the desired direction. As also known in the art, the sewing machine performs sewing on the sewing workpiece by moving up and down the sewing needle with an upper thread passed therethrough and rotating the rotary hook, disposed below the needle plate and having the lower thread housed therein, in synchronism with the up-and-down movement of the sewing needle to thereby entwine the upper thread around the lower thread. In this state, the lower thread, having moved out of the rotary hook to extend upward, is connected to the sewing workpiece with having passed through an opening (namely, needle hole) of the needle plate. Therefore, the lower thread, having been connected to the sewing workpiece above the rotary hook with having moved out thereof, is also moved by following the movement of the holding member (namely, the sewing workpiece) for forming the stitch. In accordance with a moving direction of the lower thread, a path of the lower thread relative to the trajectory of the up-and-down movement (i.e., an up-and-down movement trajectory) of the sewing needle varies too.

Depending on a moving direction of the sewing workpiece at the time of stitch formation (stitch forming direction), hitch stitches may occur in some area due to the behavior of the lower thread. Some of such hitch stitches due to the behavior of the lower thread are caused by a path of the lower thread, extending from the rotary hook toward the needle hole of the needle plate, being located to the right of the up-and-down movement trajectory of the sewing needle. In view of this point, the rotary hook construction according to the present invention is constructed such that it is possible for the path of the lower thread extending from the rotary hook toward the needle hole of the needle plate not to be located to the right of the up-and-down movement trajectory of the sewing needle. Namely, the lower thread paid out from the lower thread bobbin is directed, by the thread take-up member, to the recessed portion of the inner rotary hook and then directed to the opening (needle hole) of the needle plate after passing through the recessed portion. Because the recessed portion is formed at the position deviated from the needle drop position substantially in the rotating direction of the outer rotary hook (i.e., at a position to the left of the up-and-down movement trajectory of the sewing needle), the path of the lower thread, extending from the rotary hook toward the needle hole, is located to the left of the up-and-down movement trajectory of the sewing needle. In this manner, it is possible to prevent the path of the lower thread, extending from the rotary hook toward the needle hole, from being located to the right of the up-and-down movement trajectory of the sewing needle and thus structurally avoid occurrence of a hitch stitch due to behavior of the lower thread.

According to a second aspect of the present invention, there is provided a sewing machine which includes, in addition to the aforementioned arrangements according to the first aspect, a construction for avoiding occurrence of a hitch stitch due to behavior of the upper thread and thus can avoid occurrence of any types of hitch stitches and can form perfect stitches over an entire range of stitching directions. Namely, according to the second aspect of the present invention, there is provided a sewing machine which can form stitches as perfect stitches over the entire range of stitching directions, namely can achieve "all-perfect-stitch" sewing.

A sewing machine according to a second aspect of the present invention includes the rotary hook construction aforementioned and a sewing mechanism that performs sewing on a sewing workpiece by moving up and down the sewing needle with the upper thread passed therethrough and rotating the outer rotary hook in synchronism with the up-and-down movement of the sewing needle to thereby entwine the upper thread around the lower thread. Further, the sewing machine according to the second aspect includes: a feed mechanism that displaces a holding member, having the sewing workpiece held thereon, relative to a needle drop position, to thereby form a stitch in a desired direction on the sewing workpiece; determination means that determines whether or not a next-stitch forming direction belongs to a predetermined area in which a hitch stitch is undesirably formed; and detour control means that, upon determination that the next-stitch forming direction belongs to the predetermined area, moves the holding member via the feed mechanism so as to cause an upper thread extending downward from the sewing needle to detour in a direction corresponding to perfect stitch quality and then the holding member to move to a target position corresponding to the next stitch. By such a detouring movement of the holding member via the detour control means, the inventive sewing machine can avoid occurrence of the hitch stitch due to the behavior of the upper thread.

DETAILED DESCRIPTION

<Area in which Hitch Stitch Formation Occurs>

Figure 1:
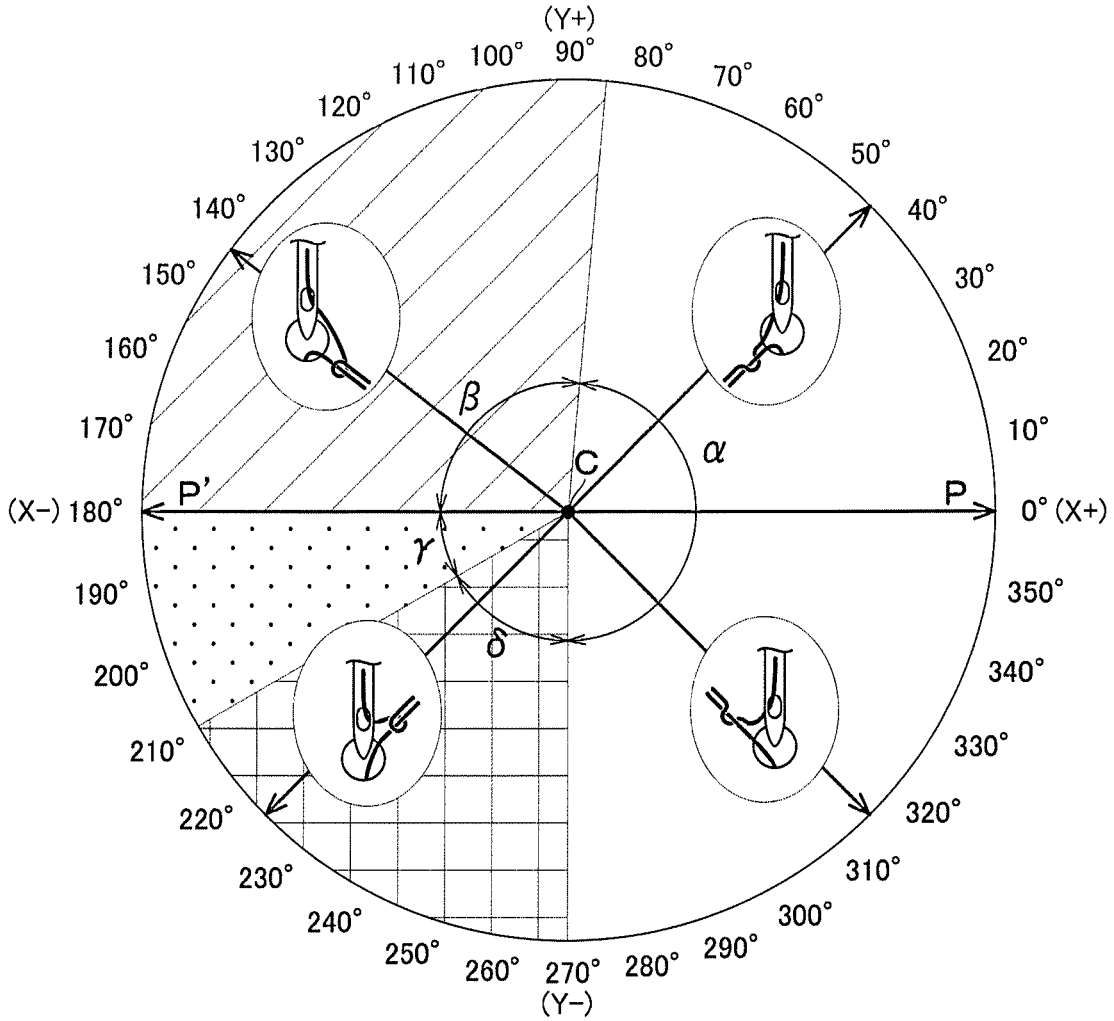
FIG. 1 is a diagram illustrating relationships between various stitch forming directions and quality of stitches (perfect stitch and hitch stitch) formed in accordance with the individual stitch forming directions.

First, with reference to FIG. 1, a description will be given about a typical example of areas of stitch forming (or occurring) directions in which hitch stitches are formed (or occur). FIG. 1 is a diagram illustrating relationships between various stitch forming directions and quality of stitches (perfect stitch and hitch stitch) formed in accordance with the stitch forming directions. Note that the relationships between the stitch forming directions and the quality of stitches formed in accordance with the stitch forming directions vary depending on an orientation and type of a rotary hook, and FIG. 1 illustrates the above-mentioned relationships for a full-rotation vertical rotary hook (so-called "DB type" rotary hook) that is commonly employed in an embroidery sewing machine. Further, it is assumed here that passage of an upper thread through an eye hole of a sewing needle is done by causing the upper thread, paid out downward from an upper thread bobbin, to enter the eye hole from the front side of the sewing needle and then pass backward or rearward through the eye hole to connect to a sewing workpiece (fabric workpiece) as commonly known in the art. The upper thread and a lower thread are entwined with each other as well known, through cooperation between the sewing needle moving up and down and the rotary hook making a full rotation in a counterclockwise direction, so that a stitch is formed on the sewing workpiece (fabric workpiece).

A base point C located at the center of the diagram represents a current needle drop position (i.e., a position of a needle hole of a needle plate in a sewing machine). Several arrows extending from the base point C denote examples of stitching directions from the base point C to next needle drop positions (i.e., next-stitch forming directions). As well known in the art, a stitching direction of each stitch can be set as desired within an angle range of 360°; typically, the stitching direction of each stitch depends on a sewing pattern. For convenience, in FIG. 1, the direction of arrow P denotes 0°, and angles from 0° to less than 360° are calibrated in a counterclockwise direction from 0°. Let it be assumed that in the following description, when an area in a particular stitching direction (next-stitch forming direction) is to be identified by an angle, the angle calibration illustrated in FIG. 1 is followed. In FIG. 1, let it be assumed that arrows P and P' respectively represent leftward and rightward directions of the sewing machine, and, for convenience, the direction represented by arrow P is a positive direction along the X axis (X+) while the direction represented by arrow P' is a negative direction along the X axis (X−). Directions of the Y axis perpendicularly intersecting the X axis at the base point C represent forward and rearward directions of the sewing machine; the rearward direction that is a direction toward the rear (back) of the sewing machine is a positive direction along the Y axis (Y+), while the forward direction that is a direction toward the front of the machine is a negative direction along the Y axis (Y−). As well known in the art, a moving direction of a holding member (frame) holding a sewing workpiece (fabric workpiece) and a direction of a stitch formed in accordance with the movement of the holding member (frame) are exactly opposite to each other. For example, when a stitch is to be formed in the arrow P direction (0° direction), the holding member (frame) is moved in the arrow P' direction (180° direction) that is exactly opposite to the arrow P direction.

Further, in FIG. 1, pictures of sewing needles, each surrounded by a circle, are illustrated in overlapping relations to the aforementioned arrows. Each of such sewing needle pictures schematically illustrates, together with a picture of the needle hole, a typical example of relationships of upper and lower threads with the sewing needle when a stitch is to be formed in the direction of the corresponding arrow, to help reader's understanding. Note that in each of the sewing needle pictures, the sewing needle in the middle of its descending movement immediately before entry in the needle hole is illustrated, but illustration of the sewing workpiece (fabric workpiece) is omitted for convenience sake.

An entire range of the stitching directions can be divided into several areas α to δ according to quality of stitches that are formed in accordance with the stitching directions. The area α is an area to which the stitching directions in which perfect stitches are formed (i.e., perfect-stitch forming directions) belong, and which covers approximately from about 270° to 360° (0°) and to about 85°. As indicated in the sewing needle pictures depicted in overlapping relations to the arrows in this area α, the sewing needle drops with the upper thread, passing from the eye hole of the sewing needle to the fabric workpiece in response to the movement of the holding member (frame), located to the left of the sewing needle, and thus, stitches formed in this area are the perfect stitches. The areas β to δ other than the area α depicted as a blank or white area in FIG. 1 are areas to which the stitching directions in which hitch stitches are formed (hitch-stitch forming directions) belong. The hatched area β is an area to which the stitching directions in which hitch stitches are formed due to the behavior of the upper thread belong and which covers approximately from about 85° to about 180°. As indicated in the sewing needle picture depicted in an overlapping relation to the arrow in this area β, the sewing needle drops with the upper thread, passing from the eye hole of the sewing needle to the fabric workpiece in response to the movement of the holding member (frame), located to the right of the sewing needle, and thus, stitches formed in this area are the hitch stitches. The dotted area γ is an area to which the stitching directions in which hitch stitches are formed due to the behavior of both of the upper and lower threads belong and which covers approximately from about 180° to about 210°. The checkered area δ is an area to which the stitching directions in which hitch stitches are formed due to the behavior of the lower thread belong and which covers approximately from about 210° to about 270°. As indicated in the sewing needle picture depicted in an overlapping relation to the arrow in this area δ, the sewing needle drops with the lower thread, passing from the rotary hook to the fabric workpiece in response to the movement of the holding member (frame), located to the right of the sewing needle, and thus, stitches formed in this area are the hitch stitches.

<Fundamental Construction of Sewing Machine>

Figure 2:
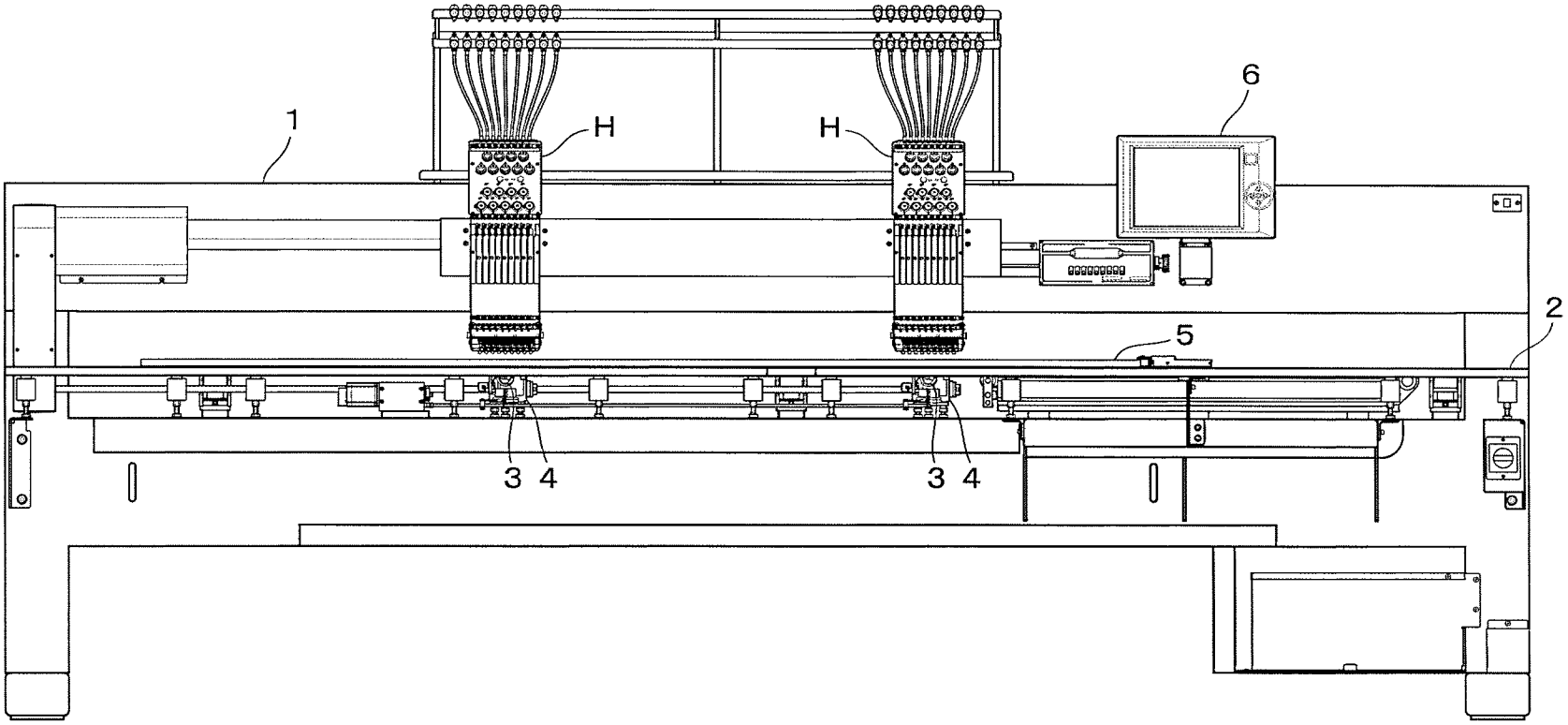
FIG. 2 is a front view of a sewing machine according to one embodiment of the present invention.

Now, with reference to FIGS. 2 to 4, a description will be given below about a fundamental construction of a sewing machine to which the present invention is applicable. However, such a fundamental construction itself is well known in the art, and any other desired construction than the illustrated example can be applied to the present invention. FIG. 2 is a front view of a sewing machine according to one embodiment of the present invention, which, as an example, illustrates the embodiment applied to a multi-head, multi-needle type embroidery sewing machine. A machine frame 1 is disposed above a table 2, and a plurality of machine heads H are disposed on the machine frame 1 along the length of the machine frame 1. Rotary hook bases 4, each supporting a respective rotary hook 3, are disposed below the machine heads H in corresponding relations to the individual machine heads H. Further, a holding member 5 for holding a sewing workpiece, such as a fabric, in an extended state is placed on the upper surface of the table 2. The holding member 5 is controllably moved in X-axis and Y-axis directions (i.e., front-rear and left-right directions) via a feed mechanism (not illustrated in the drawings) provided below the table 2. The holding member 5 is one commonly known as an embroidery frame, a fabric-workpiece holding frame, or the like, and the holding member 5 will hereinafter be referred to as "frame 5". An operation panel 6 for operating the sewing machine and making various settings is provided to the right of the machine frame 1. The operation panel 6 is, for example, in the form of a touch panel and includes a display section for displaying various information and an input section via which various instructions are given. Note that the above-mentioned feed mechanism operates to displace the frame 5, holding the sewing workpiece, relative to a needle drop position and thereby cause a stitch to be formed on the sewing workpiece in a desired direction. Such a feed mechanism itself is well known in the art and thus will not be described in detail here.

Figure 3:
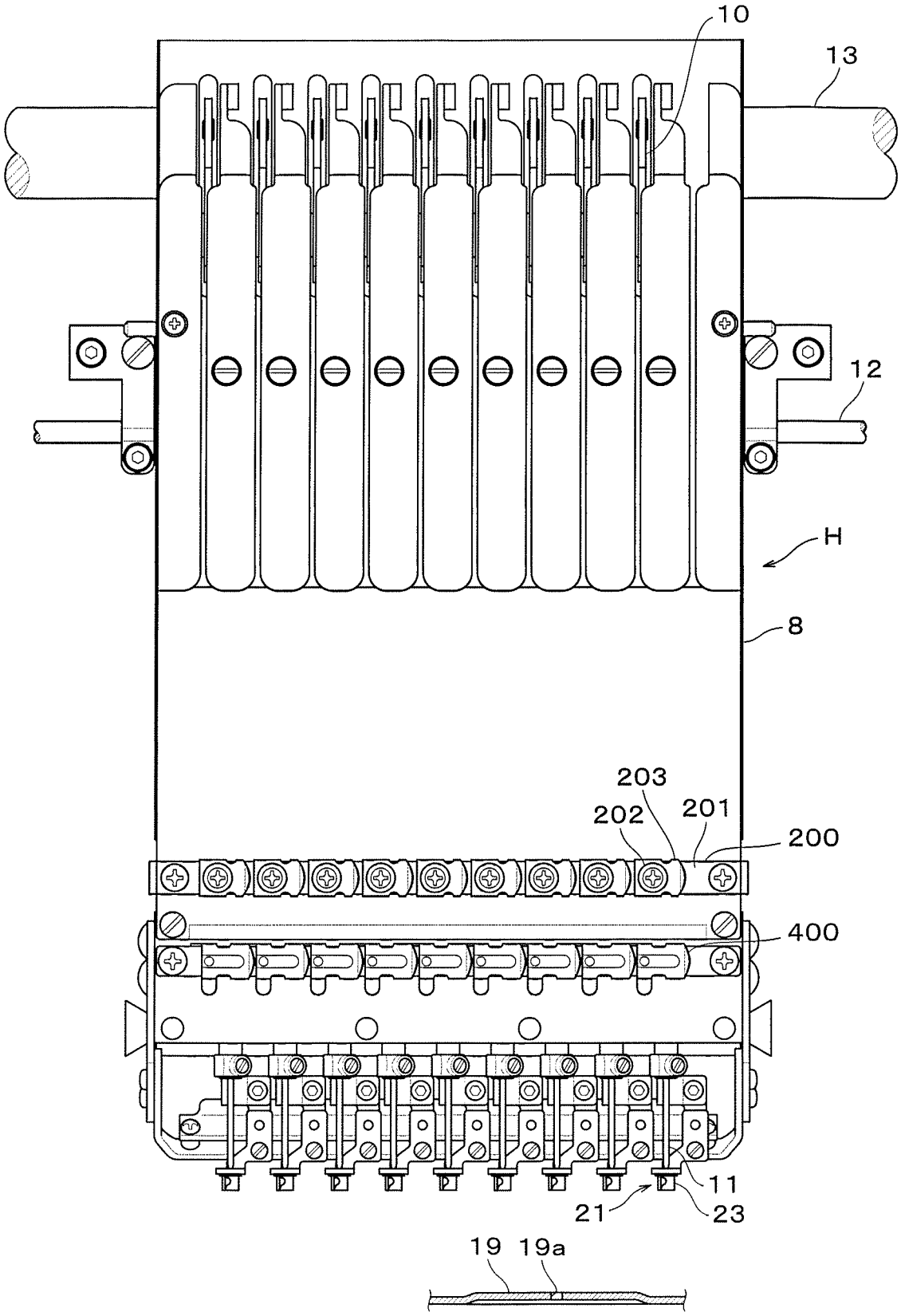
FIG. 3 is a front view illustrating at an enlarged scale one machine head in the embodiment illustrated in FIG. 2.
Figure 4:
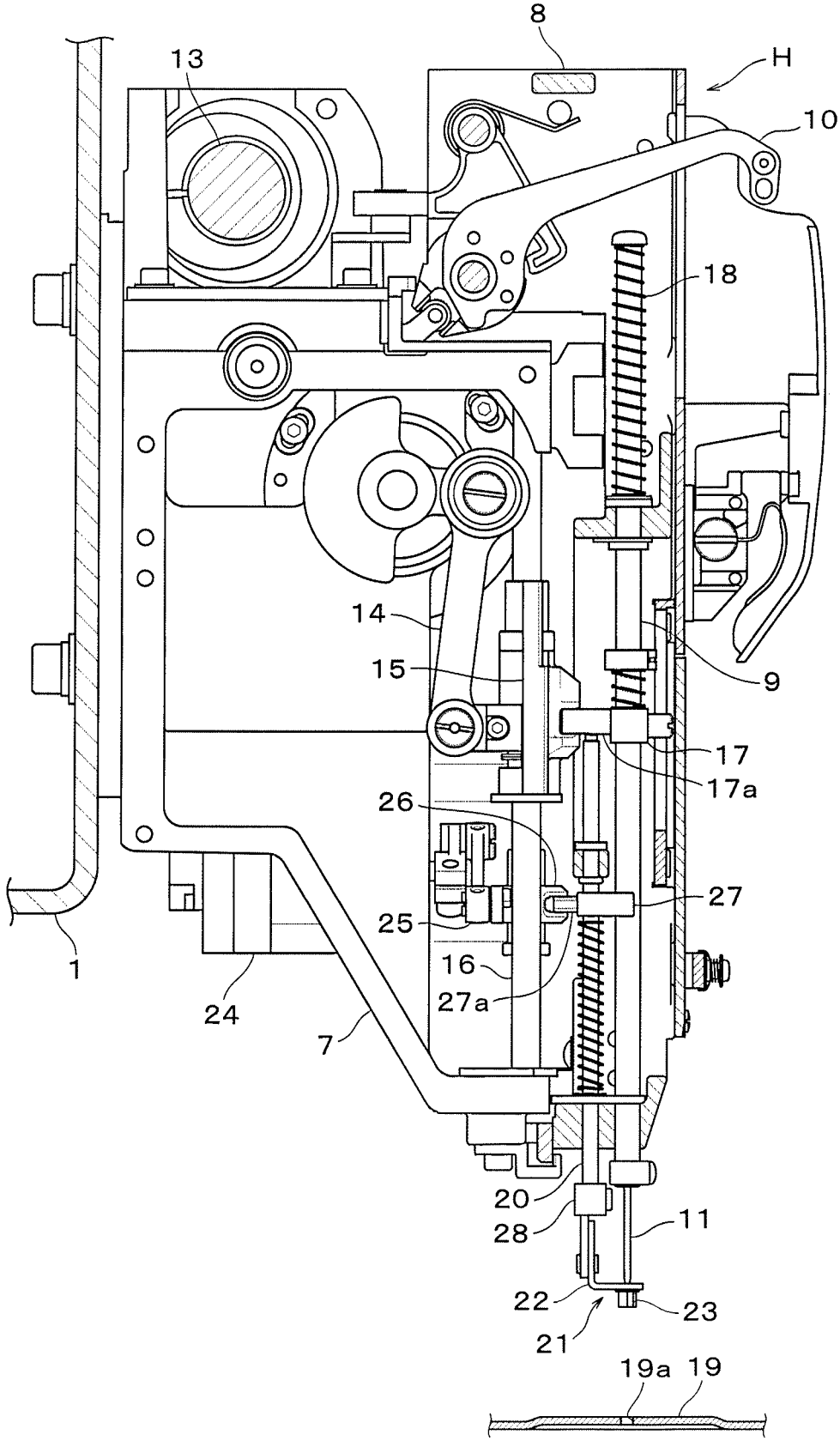
FIG. 4 is a sectional side view of the machine head illustrated in FIG. 3.

FIG. 3 is a front view of one of the machine heads H, and FIG. 4 is a side view of the machine head H. A needle bar case 8 is supported on the front surface of a machine arm 7, mounted on the front surface of the machine frame 1, in such a manner that the needle bar case 8 is slidable in the left-right direction along the machine arm 7. A plurality of needle bars 9 are supported in the needle bar case 8 in such a manner that the bars 9 are movable up and down, and thread take-up levers 10 corresponding to the individual needle bars 9 are pivotably provided in the needle bar case 8. Each of the needle bars 9 is disposed in such a manner that its axis extends in the up-down direction (vertical direction), a sewing needle 11 is mounted at the lower end of each of the needle bars 9. Note that an upper thread T is passed rearward through an eye hole 11*a* of the sewing needle 11 from the front side of the eye hole 11*a* (see FIGS. 5, 20 and the like). A slide shaft 12 extends through the needle bar case 8 in such a manner that the needle bar case 8 is slidingly moved in the left-right direction by sliding the slide shaft 12 laterally via a not-illustrated motor. In response to the sliding movement of the needle bar case 8, any one of the plurality of needle bars 9 is selectively positioned at an operating position; in this manner, one needle bar 9 that should be caused to operate is selected.

A machine shaft 13 is passed through the machine arm 7, and as the main shaft 13 is rotated via a not-illustrated main shaft motor, a needle bar driving member 15 is moved up and down along a base shaft 16 via a not-illustrated cam mechanism, a link 14, and the like provided within the machine arm 7. The needle bar driving member 15 is constructed to engage with a locking pin 17*a* of a needle bar connecting stud 17 fixed to a predetermined position of the needle bar 9, and the needle bar driving member 15 is switchable between a catch position for catching the needle bar 9 and a non-catch position. In the catch position, the needle bar driving member 15 engages with the locking pin 17*a* of the needle bar connecting stud 17 as illustrated in FIG. 4. In the non-catch position, the needle bar driving member 15 is released from the engagement with the locking pin 17*a* of the needle bar connecting stud 17, so that the needle bar 9 is held at an upper position (top dead point) by resilient return force of a tension spring 18 provided on an upper portion of the needle bar 9. When a sewing operation is to be performed by actually moving up and down the needle bar 9 (and the sewing needle 11), the needle bar driving member 15 is constantly set in the catch position. Control for temporarily stopping the needle bar 9 (and the sewing needle 11) at the top dead point during the sewing operation is commonly known as jump control. When such jump control is to be performed, the needle bar driving member 15 is temporarily set in the non-catch position. To perform such jump control, a conventionally known jump mechanism is provided in the machine head H. Namely, such a jump mechanism is a mechanism that, when the jump control is to be performed during the sewing operation, holds the sewing needle 11 at the upper position without causing the sewing needle 11 to descend or move down. As an example, the jump mechanism includes a jump motor (not illustrated) provided on the arm 7, a driving member (not illustrated) that sets the needle bar driving member 15 in the non-catch position by, in response to driving by the jump motor, pivoting the needle bar driving member 15 about the base shaft 16 through a predetermined angle, the abovementioned tension spring 18, and the like.

The needle bar 9 selected to be positioned at the operating position is moved up and down, in response to ascending and descending movement of the needle bar driving member 15, while being caught by the needle bar driving member 15. In the course of the up-down movement of the needle bar 9 positioned at the operating position, the sewing needle 11 mounted at the distal end of the needle bar 9 is passed through a needle hole 19*a* of a needle plate (or throat plate) 19, so that the sewing operation is performed in the well-known manner. Once the above-mentioned jump mechanism is actuated by being driven by the jump motor (not illustrated), the needle bar driving member 15 is set in the non-catch position in such a manner that the needle bar 9 is shifted to a jumped state and held at the top dead point as noted above without being caught by the needle bar driving member 15.

A lifting rod 20 is provided, behind a respective one of the needle bars 9, in the needle bar case 8 in such a manner that the rod 20 is movable up and down. The lifting rod 20 has an axis extending in the up-down direction (vertical direction) similarly to the needle bar 9, and a presser foot device 21 is provided at the lower end of each of the lifting rods 20. Such a presser foot device 21 functions to press and hold down the sewing workpiece in place from above in response to the descending movement of the sewing needle 11, and the presser foot device 21 includes a pressing member 22 and a guide member 23 as will be set forth in detail later. The pressing member 22 is mounted to the lower end of the lifting rod 20, and the guide member 23 is mounted to the lower end of the pressing member 22. One of the lifting rods 20 that corresponds to the needle bar 9 selectively set at the operating position is driven by a fabric pressing motor 24 provided on the machine frame 7, and a link mechanism 25 is connected to the fabric pressing motor 24. As the fabric pressing motor 24 is reciprocatively rotated, a fabric pressing driving member 26 provided on the machine frame 7 is moved up and down via the link mechanism 25. The fabric pressing driving member 26 is constructed to engage with a locking pin 27*a* of a lifting rod connecting stud 27 fixed to a predetermined position of the lifting rod 20. The locking pin 27*a* of one of the lifting rods 20, provided in the needle bar case 8, that corresponds to the needle bar 9 selectively set at the operating position engages with the fabric pressing driving member 26, and thus, the lifting rod 20 is moved up and down in its axial direction, together with the presser foot device 21 (the pressing member 22 and the guide member 23), in response to the ascending/descending movement of the fabric pressing driving member 26. When the needle bar 9 is to be jumped by the above-mentioned jump mechanism, the fabric pressing motor 24 is de-actuated in such a manner that the presser foot device 21 (the pressing member 22 and the guide member 23) is stopped at the predetermined upper portion (top dead point).

A combination of the machine head H and the rotary hook 3 corresponding to the machine head H constitutes a sewing mechanism that moves up and down the sewing needle 11 with an upper thread passed therethrough and rotates the rotary hook 3, having a lower thread housed therein, in synchronism with the up-and-down movement of the sewing needle 11 to thereby entwine the upper thread around the lower thread for performing sewing on the sewing workpiece.

<Construction of Presser Foot Device>

Figure 5:
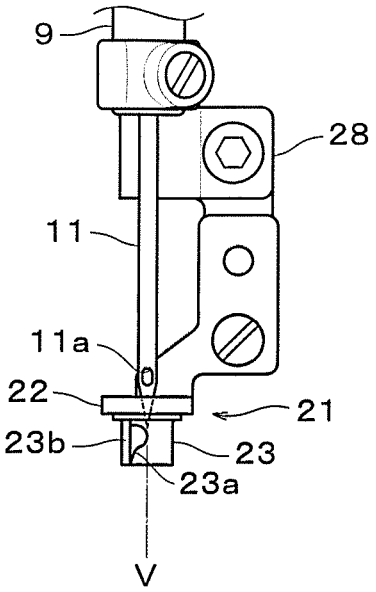
FIG. 5 is an enlarged front view illustrating an embodiment of a presser foot device for holding down a sewing workpiece in place.

FIG. 5 is an enlarged front view of an embodiment of the presser foot device 21. A mounting member 28 is provided at the lower end of the lifting rod 20, and the pressing member 22 of the presser foot device 21 is detachably mounted on the mounting member 28 by use of a screw. A lower end portion of the pressing member 22 extends downward to a position immediately below the needle bar 9 and has a through-hole 22*a* for passage therethrough of the sewing needle 11. Thus, when the pressing member 22 descends, in response to the descending movement of the needle bar 9, to hold down the sewing workpiece in place from above, the sewing needle 11 descends further to pass through the through-hole 22*a* and pierce the sewing workpiece, so that sewing is performed on the sewing workpiece. The aforementioned construction of the presser foot device 21 is similar to the construction of the well-known fabric presser foot device. The presser foot device 21 provided in the present embodiment is characterized in that the guide member 23 projecting downward is provided at the lower end of the pressing member 22. Note that the constituent components 22, 23 and the like of the presser foot device 21 may be formed of a suitable material, such as metal.

The guide member 23, which is of a substantially cylindrical shape, has a hollow portion (opening extending in the vertical direction) communicating with the through-hole 22*a* of the pressing member 22 in such a manner that the sewing needle 11 having passed through the through-hole 22*a* can pass through the hollow portion of the guide member 23 vertically or in the up-down direction. The guide member 23 is not of a complete cylindrical shape and has an opening section (recessed section) 29 that opens to the lower end of the guide member 23 and extends over an area from a position opposed to the front left of the sewing needle 11, passing through the opening section 29, to a position opposed to the left side surface of the sewing needle 11, as viewed in front view (see also FIG. 8). Of course, the opening section (recessed section) 29 is in communication with the hollow portion of the guide member 23 in such a manner that a portion of the upper thread, having been passed through the eye hole 11*a* of the sewing needle 11 passing through the hollow portion, (i.e., a portion of the upper thread connecting to the sewing workpiece) can move out of the guide member 23 via the opening section 29 depending on in which direction the frame 5 is moved. Because the counterclockwise rotating direction of the rotary hook 3 is, in other words, a generally leftward direction as viewed in top plan view, it may be said that the opening section 29 formed generally to the left of the sewing needle 11 as viewed in front view is formed to allow or enable the upper thread to pass therethrough substantially in the rotating direction of the rotary hook 3. Because the presser foot device 21 is constructed to enable the upper thread to move out of the guide member 23 via the opening section 29, the upper thread can be entwined around the sewing needle 11 in the counterclockwise direction (i.e., in the rotating direction of the rotary hook 3) in accordance with any one of the moving directions of the frame 5 which vary over a wide range as will be set forth in detail later.

In the guide member 23, the front edge and rear edge of the opening section 29 formed generally to the left of the sewing needle 11 correspond respectively to front and rear edge portions 23*a* and 23*b* of the guide member 23. Namely, the opening section 29 is demarcated by the above-mentioned front and rear edges, and when the upper thread takes a detour to move in another direction after having moved out the opening of the guide member 23, such detouring movement of the upper thread is restricted by the front or rear edge portion 23*a* or 23*b* of the guide member 23. Such a restricting action by the front edge portion 23*a* plays an important role to avoid occurrence of a hitch stitch due to the behavior of the upper thread. Therefore, a wall portion of the guide member 23 extending forward from the front edge (i.e., front edge portion 23*a*) of the opening section 29 will hereinafter be referred to as "restricting section 23*a*". In the present embodiment, the movement of the upper thread in a direction away from the front edge of the opening section 29, formed generally to the left of the sewing needle 11, which is to be restricted by the restricting section 23*a*, namely by the front edge portion 23*a*, is generally rightward movement. Stated differently, the upper thread's movement to be restricted by the restricting section 23*a* is movement in a direction opposite to the rotating direction (counterclockwise direction) of the rotary hook 3. Therefore, it may be said that the restricting section 23*a* of the guide member 23 is provided in such a manner as to restrict the movement of the upper thread in the direction opposite to the rotating direction of the rotary hook 3.

As noted above, the opening section 29 is provided to open to the lower end of the guide member 23. Thus, the restricting section 23*a* defining the front edge of the opening section 29 is provided in such a manner as to restrict the movement of the upper thread, passing through the opening section 29, in the direction opposite to the rotating direction of the rotary hook 3 until the upper thread reaches the lower end of the guide member 23. Thus, the upper thread in the state of being restricted by the restricting section 23*a* is caused to move along the restricting section 23*a* to the lower end of the guide member 23 in response to the descending of the sewing needle 11. Then, by passing downward through the opening section 29, the upper thread is released from the restriction by the restricting section 23*a*. Once the upper thread is released from the restriction by the restricting section 23*a*, the upper thread twines around the sewing needle 11 in the counterclockwise direction (i.e., in the rotating direction of the rotary hook 3). As an example, the restricting section 23*a* of the guide member 23 is provided to extend over a suitable area extending forward from the front edge of the opening section 29. As will be described in detail later, the restricting section 23*a* of the guide member 23 is provided for preventing the upper thread from being located to the right of the sewing needle 11 (in other words, for causing the upper thread to twine around the sewing needle 11 in the counterclockwise direction) when the sewing needle 11 pierces the sewing workpiece, in order to avoid occurrence of a hitch stitch due to the behavior of the upper thread. In FIG. 5, reference character V denotes a vertical or up-and-down movement trajectory of the sewing needle 11. Note that for the purpose of preventing the upper thread from being located to the right of the sewing needle 11 when the sewing needle 11 pierces the sewing workpiece, the restricting section (front edge portion) 23*a* of the guide member 23 or at least the lower end of the restricting section 23*a* (that abuts against the sewing workpiece) is located to the left of the up-and-down movement trajectory V of the sewing needle 11. Namely, the restricting section 23*a* is provided so as to restrict the movement of the upper thread at a position deviated from the movement trajectory V of the sewing needle 11 substantially in the rotating direction of the rotary hook 3 (or deviated leftward of the trajectory V).

In the embodiment illustrated in FIG. 5 (or FIG. 8), the front edge of the opening section 29, namely the restricting section (front edge portion) 23*a* of the guide member 23, has a shape recessed obliquely from an upper part of the member 23 toward a left lower end of the member 23. Because of such a slantingly recessed shape, an upper or central open area of the opening section 29 is somewhat wider in the forward direction than a lower open area of the opening section 29. Thus, when some slackness has occurred in a portion of the upper thread restricted by the restricting section 23*a* after moving out of the opening section 29 during the descending movement of the sewing needle 11 and the pressing member 22, the slackness can be absorbed by the wider open area of the opening section 29; thus, appropriate holding of the upper thread by the restricting section 23*a* can be maintained as long as possible, so that it is possible to prevent as effectively as possible the upper thread from undesirably coming off the restricting section 23*a* before the sewing needle 11 pierces the sewing workpiece. However, such slanting of the restricting section is not necessarily essential, and the front edge of the opening section 29, namely the restricting section (front edge portion) 23*a* of the guide member 23, may be formed to extend in the vertical direction.

Figure 6:
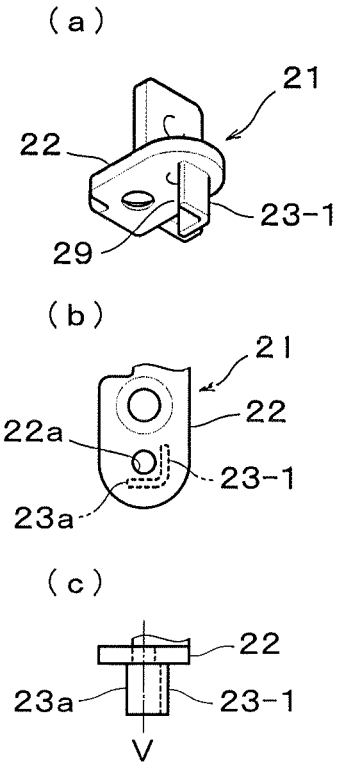
FIG. 6 illustrates a modification of a guide member of the presser foot device, of which (a) is a bottom perspective view of the guide member, (b) is a top plan view of the guide member, and (c) is a front view of the guide member.

Note that the guide member 23 may be of any suitable outer shape without being limited to the substantially cylindrical shape as described above. FIG. 6 illustrates a modification of the guide member 23, of which (a) is a bottom perspective view, (b) is a top plan view, and (c) is a front view. The guide member 23-1 illustrated in FIG. 6 has two side wall surfaces interconnected at a suitable angle (for example, about 90°), and a hollow space defined by these side surfaces and an adjoining hollow space function as a hollow space for allowing passage therethrough of the sewing needle 11 (this space corresponds to the above-mentioned hollow portion) and as a hollow space of the opening section 29 for allowing passage therethrough of the upper thread substantially in the rotating direction of the rotary hook 3. The front side wall surface of the two side wall surface of the guide member 23-1 functions as the restricting section 23*a*.

Figure 7:
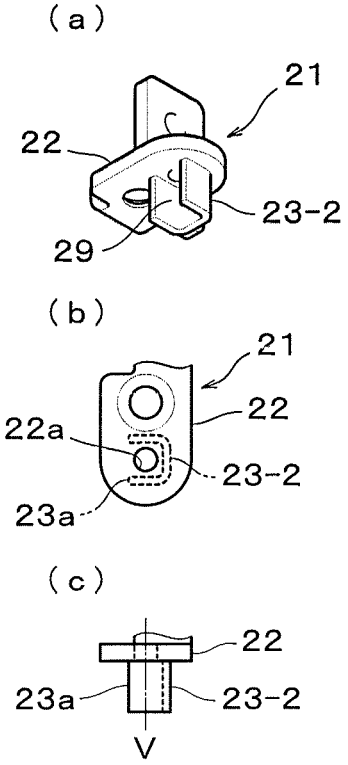
FIG. 7 illustrates another modification of the guide member of the presser foot device, of which (a) is a bottom perspective view, (b) is a top plan view, and (c) is a front view.

FIG. 7 illustrates another modification of the guide member 23, of which (a) is a bottom perspective view, (b) is a top plan view, and (c) is a front view. The guide member 23-2 illustrated in FIG. 7 has three side wall surfaces interconnected at a suitable angle (for example, about 90°), and a hollow space defined by the three side wall surfaces and an adjoining hollow space function as a hollow space for allowing passage therethrough of the sewing needle 11 (this space corresponds to the above-mentioned hollow portion) and a hollow space of the opening section 29 for allowing passage therethrough of the upper thread substantially in the rotating direction of the rotary hook 3. The front side wall surface of the three side wall surfaces of the guide member 23-2 functions as the restricting section 23*a*.

Whereas the guide members 23 illustrated in FIGS. 5 to 7 each have the front side wall surface and the front edge portion of the front side wall surface functions as the restricting section 23*a*, the present invention is not so limited, and the restricting section 23*a* may be in the form of a pin-shaped or line-shaped thin pole member having no side wall surface. For example, two such thin pole members may be provided in such a manner as to form a hollow space as the opening section 29 between the two pole members, and one of the pole members located in front of the other pole member may be made to function as the restricting section 23*a*. In such a case, an arc-shaped connecting foot portion may be provided opposite to the opening section 29 so as to interconnect the respective lower ends of the two thin pole members. As still another modification, one or more other thin pole members may be provided to be surrounded by the arc-shaped connecting foot portion. As yet another modification, the guide member 23 may be in the form of only one thin pole member functioning as the restricting section 23*a*.

Figure 8:
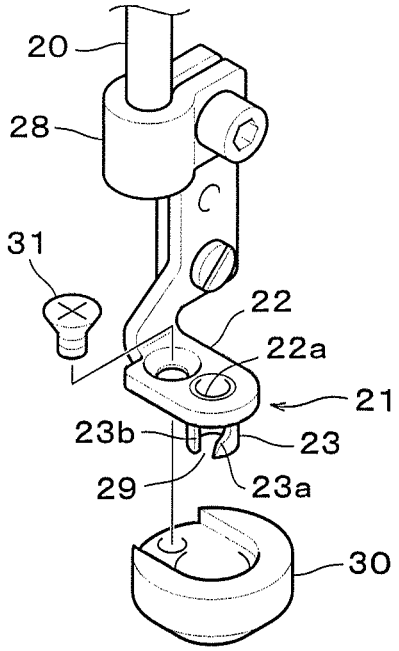
FIG. 8 is a perspective view illustrating still another modification of the presser foot device, in which a cover is provided on a lower portion of the presser foot device.

FIG. 8 is a perspective view illustrating another modification of the presser foot device 21, in which a cover 30 is provided beneath the pressing member 22 for covering the guide member 23. The presser foot device 21 illustrated in FIG. 8 is constructed in the same manner as the presser foot device 21 illustrated in FIG. 5 except for elements pertaining to the cover 30. The cover 30 has a bottom portion with a smoothly rounded, downwardly convex curved bottom surface (bowl-like bottom surface), and a through-hole of a relatively large diameter is formed in the bottom portion in such a manner as to loosely receive therein the guide member 23. The cover 30 is also recessed in an upper inner surface portion thereof for fitting engagement with the pressing member 22. By attaching the cover 30 to the guide member 23 from below and fastening the cover 30 to the guide member 23 by a screw, the cover 30 is assembled and fixed to the pressing member 22 so as to cover the outer peripheral surface of the guide member 23. Because the guide member 23 is loosely received in the cover 30 with some gap therebetween, the aforementioned function of the guide member 23 is never impaired. Because a lower end portion of the guide member 23 is surrounded by the convexly convex curved (bowl-like) bottom surface of the cover 30, it is possible to prevent the guide member 23 from undesirably catching on a stitch on the moving sewing workpiece, even if, for example, an up-and-down stroke of the presser foot device 21 is reduced in order to prevent fluttering of the sewing workpiece.

<Needle Plate Construction>

Figure 9:
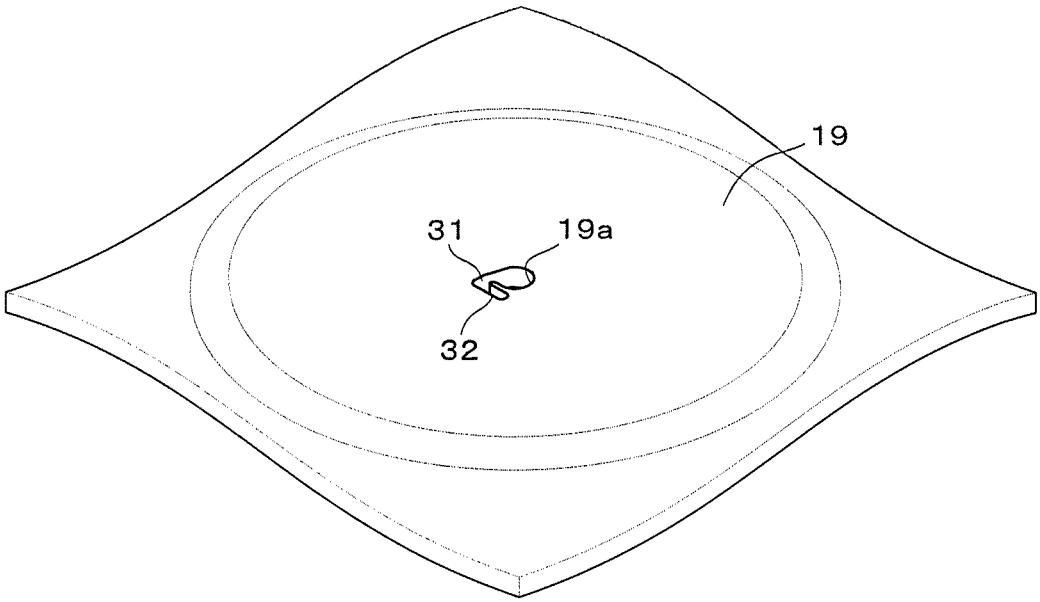
FIG. 9 is a sectional perspective view illustrating an embodiment of a needle plate construction.
Figure 10:
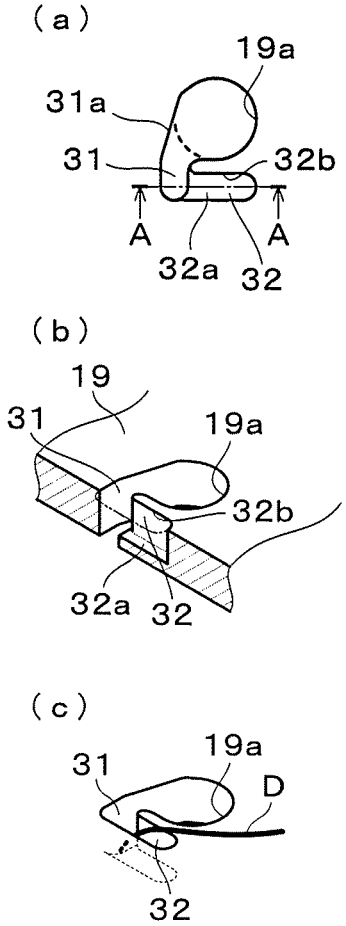
FIG. 10 is a view illustrating at an enlarged scale a needle hole and portions around the needle hole illustrated in FIG. 9, of which (a) is a top plan view, (b) is a perspective view illustrating a section taken along line A-A of (a), and (c) is a fragmentary perspective view illustrating a path of a lower thread.

In the present embodiment, a novel construction is employed, in relation to the needle hole 19*a* of the needle plate 19, for avoiding occurrence of a hitch stitch due to the behavior of the lower thread. FIG. 9 is a sectional perspective view illustrating an embodiment of such a novel needle plate construction. FIG. 10 illustrates at an enlarged scale the needle hole 19*a* and portions around the needle hole 19*a*, of which (a) is a top plan view, (b) is a perspective view illustrating a section taken along line A-A of (a), and (c) is a fragmentary perspective view illustrating a path of the lower thread D. As in the conventionally known construction, the needle hole 19*a* is a substantially simple circular hole as illustratively denoted with a dotted line in FIG. 10(*a*). The vertical or up-and-down movement trajectory (denoted by V in FIG. 5) of the sewing needle 11 passes through a substantial center of the circle.

In the needle plate construction according to the present embodiment, a guide hole 31 and a groove portion 32 are provided in the needle plate 19 in relation to the needle hole 19*a*. The guide hole 31 formed through the needle plate 19 is located near the front of the sewing machine and is in communication with the needle hole 19*a*. Further, the guide hole 31 is located at a position deviated from the up-and-down movement trajectory of the sewing needle 11 substantially in the rotating direction of the rotary hook 3 (i.e., deviated leftward from the up-and-down movement trajectory in FIG. 10(*a*)). Further, the groove portion 32 of the needle plate 19 is located in front of the needle hole 19*a* and extends from the guide hole 31 in a direction opposite to the rotating direction of the rotary hook 3 (i.e., extends rightward from the guide hole 31 in FIG. 10(*a*)). While the groove portion 32 opens upward and opens laterally at its part communicating with the guide hole 31, the remaining part of the groove portion 32 is defined by a bottom surface 32 and side walls 32*b* (FIG. 10(*b*)). As well known, during the sewing operation, the lower thread D having moved out of the rotary hook 3 passes through the needle hole 19*a* to extend upward and thereby forms a stitch on the sewing workpiece. The needle plate 19 in the embodiment is constructed in such a manner that the lower thread D having moved out of the rotary hook 3 passes through not only the needle hole 19*a* but also the guide hole 31 communicating with the needle hole 19*a*. When the lower thread D passes through the guide hole 31, a portion of the lower thread D having moved upward from the guide hole 31 can be guided via the groove portion 32 to a position located in front of the needle hole 19*a* as illustrated in FIG. 10(*c*), depending on a moving direction of the frame 5. Because the groove portion 32 has the bottom surface 32*a*, an upper portion of the lower thread D is bent upward and guided to an upper hollow space of the groove portion 32 via the bottom surface 32*a* with a lower portion of the lower thread D remaining in the guide hole 31.

Further, the guide hole 31 is located deviated from the up-and-down movement trajectory of the sewing needle 11 substantially in the rotating direction of the rotary hook 3 (i.e., deviated leftward from the up-and-down movement trajectory) and the groove portion 32 extends, in front of the needle hole 19*a*, from the guide hole 31 in the direction opposite to the rotating direction of the rotary hook 3 (i.e., extends rightward from the guide hole 31), as noted above. Thus, as the frame 5 is moved generally leftward by later-described detouring movement control (or detour control) of the frame 5, the lower thread D is guided into the guide hole 31. Then, as the frame 5 is moved generally rightward to the needle drop position (target position), the lower thread D is guided from the guide hole 31 generally rightward along the groove portion 32. Because both side surfaces of the groove portion 32 are defined by the side walls 32*b*, the lower thread D is received or engaged by a rear side surface of the side walls 32*b* (i.e., rear side wall 32*b*) and kept in front of the up-and-down movement trajectory of the sewing needle 11 without shifting rearward of the up-and-down movement trajectory of the sewing needle 11. Because the path of the lower thread D extending from the rotary hook 3 toward the needle hole 19*a* of the needle plate 19 is kept in front of the up-and-down movement trajectory of the sewing needle 11 without shifting rearward of the up-and-down movement trajectory of the sewing needle 11 in the aforementioned manner, it is possible to avoid occurrence of a hitch stitch (particularly, double hitch stitches). Further, because the groove portion 32 has the bottom surface 32*a*, a loop of the upper thread (upper thread loop), passing through the needle hole 19*a* to go upward along the lower thread D while reducing the size of the loop, can be prevented from undesirably getting caught in the groove portion 32, and thus, it is possible to avoid occurrence of breakage of the upper thread. Furthermore, because the lower thread D is merely received or engaged by the rear side wall 32*b*, the lower thread D can readily separate from, or is readily separated or disengaged from, the groove portion 32 to return to a normal path (i.e., a path passing through the needle hole 19*a*) as the lower thread D is pulled up in response to the upward movement of the upper thread, and thus, formation of the path of the lower thread D at the time of next stitch formation will not be adversely influenced.

In a portion where the guide hole 31 connects to the needle hole 19*a*, as illustrated by way of example in the top plan view of FIG. 10(*a*), a rear side wall surface 31*a* of the guide hole 31 slants from its rear end portion forward substantially in the rotating direction of the rotary hook 3 (i.e., slants in a diagonally forward left direction). Namely, this wall surface 31*a* slants in the diagonally forward left direction from its rear end in such a manner that the rearmost end of the surface 31*a* is located nearest to the up-and-down movement trajectory of the sewing needle 11 and the frontmost end of the surface 31*a* is located to the left of and farthest from the up-and-down movement trajectory of the sewing needle 11. When the path of the lower thread D is to be shifted from the needle hole 19*a* to the guide hole 31 at the time of the detouring movement control of the frame 5, the slanting of the wall surface 31*a* in the connecting portion effectively contributes to a smooth shift of the lower thread path from the needle hole 19*a* to the guide hole 31. However, the present invention is not so limited, and the configuration of the connecting portion may be designed in any other desired suitable manner.

<Rotary Hook Construction>

Figure 11:
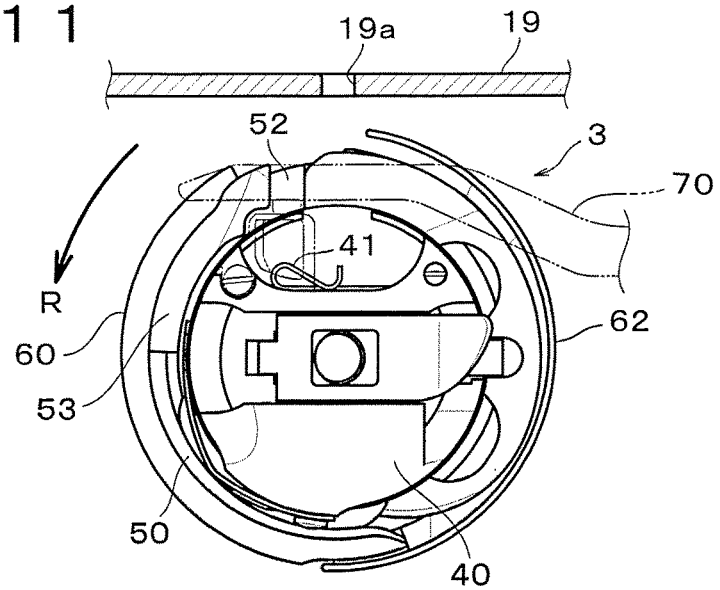
FIG. 11 is a front view illustrating an embodiment of a rotary hook construction.
Figure 12:
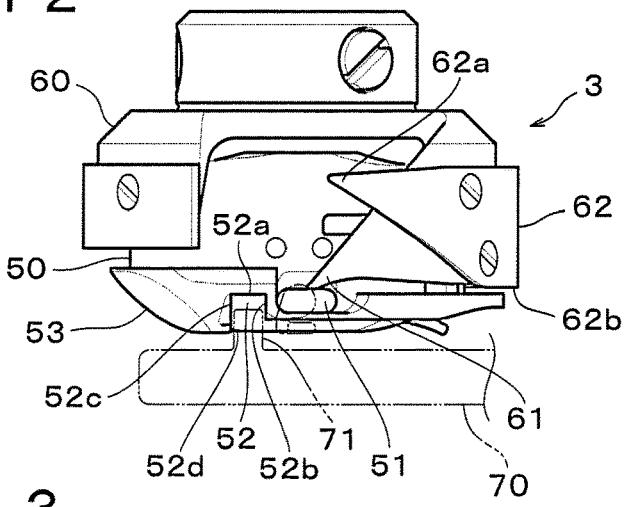
FIG. 12 is a top plan view of the rotary hook construction illustrated in FIG. 11.
Figure 13:
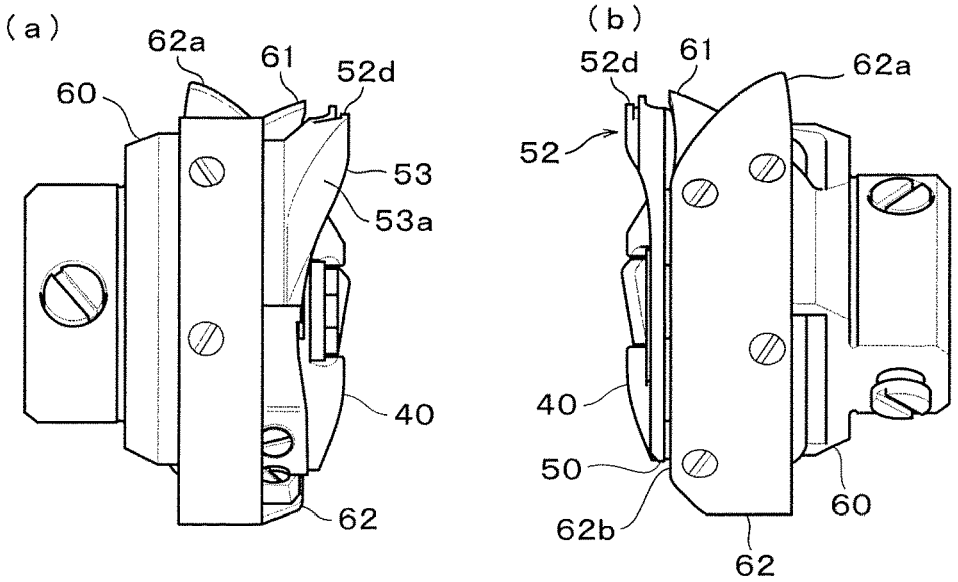
FIG. 13 is a left side view and a right-side view of the rotary hook construction illustrated in FIG. 11.

In the present embodiment, a novel construction is provided, in relation to the rotary hook 3, for avoiding occurrence of a hitch stitch due to the behavior of the lower thread. FIG. 11 is a front view illustrating an embodiment of such a novel construction of the rotary hook, and FIG. 12 is a top plan view of the novel construction of the rotary hook. FIG. 13(*a*) and FIG. 13(*b*) are respectively a left side view and a right side view of the novel construction of the rotary hook. As well known in the art, the rotary hook 3 is disposed beneath the needle plate 19. As an example, the rotary hook 3 is a full-rotation vertical rotary hook ("DB type" rotary hook). The rotary hook 3 includes a bobbin case 40 that rotatably houses a lower thread bobbin (not illustrated) having a lower thread wound thereon, an inner rotary hook 50 that houses the bobbin case 40, and an outer rotary hook 60 that rotates around the inner rotary hook 50 in synchronism with the up-and-down movement of the sewing needle 11. As known in the art, the inner rotary hook 50 is fixed to a rotary hook base 4 via a rotary hook support 70, and the bobbin case 40 is fixed within the inner rotary hook 50. The outer rotary hook 60 is fixed to a lower shaft (not illustrated) that rotates in synchronism with the up-and-down movement of the sewing needle 11, and thus, the outer rotary hook 60 rotates together with the lower shaft. In the full-rotation vertical rotary hook ("DB type" rotary hook), a rotating direction R of the outer rotary hook 60 is counterclockwise. In an upper front surface portion of the inner rotary hook 50, a needle drop hole 51 is provided to avoid interference with the sewing needle 11.

Further, in an upper front surface portion of the inner rotary hook 50, a recessed portion 52 is formed at a position deviated from the needle drop hole 51 in the rotating direction R of the outer rotary hook 60. The recessed portion 52 opens forward and upward and downward and has a rear wall surface 52*a* that is formed to be located at a substantial limit position where the rear wall surface 52*a* does not interfere with a movement trajectory of a hook point 61 of the outer rotary hook 60. Because the rear wall surface 52*a* of the recessed portion 52 is located at the substantial limit position as noted above, the lower thread path leading from the recessed portion 52 to the sewing workpiece (i.e., changing positions of the lower thread from the recessed portion 52 toward the needle hole 19*a*) can be set as far rearward as possible of the needle drop position (up-and-down movement trajectory of the sewing needle), and thus, a range over which occurrence of a hitch stitch due to the behavior of the lower thread can be avoided can be expanded as much as possible. Left and right side wall surfaces of the recessed portion 52 are respectively surfaces of an upstream side wall 52*b* located upstream in the rotating direction R of the outer rotary hook 60 and a downstream side wall 52*c* located downstream in the rotating direction R of the outer rotary hook 60.

On a predetermined position of the bobbin case 40 near the upper end of the bobbin case 40 (preferably, beneath the recessed portion 52), a thread take-up member 41 is provided for directing (guiding) the lower thread, paid out from the lower thread bobbin, toward the recessed portion 52 of the inner rotary hook 50. As will be described in detail later, the lower thread, paid out from the lower thread bobbin within the bobbin case 40, is pulled upward after passing through a hollow space of the recessed portion 52 of the inner rotary hook 50 via the thread take-up member 41. The lower thread having passed through the recessed portion 52 is entwined with the upper thread loop in response to the rotation of the outer rotary hook 60 as conventionally known and then moved upward through the needle hole 19*a* in response to the ascending movement of the sewing needle 11, thereby forming a stitch. In the aforementioned manner, the recessed portion 52 formed in the inner rotary hook 50 functions to form the path of the lower thread.

With the above-described rotary hook construction, the path of the lower thread leading from the rotary hook 3 to the sewing workpiece, located above the rotary hook 3, through the needle hole 19*a* of the needle plate 19 is caused to be located to the left of the up-and-down movement trajectory of the sewing needle 11 (needle drop position) after passing through the recessed portion 52 provided in the upper front surface portion of the inner rotary hook 50. Namely, the lower thread paid out from the lower thread bobbin is directed by the thread take-up member 41 to the recessed portion 52 of the inner rotary hook 50 and then directed to the needle hole 19*a* of the needle plate 19 after passing through the recessed portion 52. Because the recessed portion 52 is formed at the position deviated from the needle drop hole 51 in the rotating direction R of the outer rotary hook 60 (i.e., located to the left of the up-and-down movement trajectory of the sewing needle 11) and the rear wall surface 52*a* of the recessed portion 52 is formed at the substantial limit position where the rear wall surface 52*a* does not interfere with the movement trajectory of the hook point 61 of the outer rotary hook 60 as noted above, the path of the lower thread leading from the rotary hook 3 toward the needle hole 19*a* is located to the rear left of the up-and-down movement trajectory of the sewing needle 11. In this way, it is possible to prevent the path of the lower thread, leading from the rotary hook 3 toward the needle hole 19*a*, from being located to the right of the up-and-down movement trajectory of the sewing needle 11 and thereby reduce occurrence of hitch stitches.

A further description will be given about the aforementioned arrangements with reference to FIG. 1. In the area δ to which the stitching directions in which hitch stitches are formed due to the behavior of the lower thread belong, the frame 5 is moved in a rearward right direction that is 180° opposite to the stitching direction. Thus, in a conventionally known rotary hook of a type where the lower thread is fed from below the up-and-down movement trajectory of the sewing needle, the sewing needle drops with the path of the lower thread located to the right of the up-and-down movement trajectory of the sewing needle by the lower thread being pulled by a sewing workpiece, which undesirably results in occurrence of a hitch stitch. By contrast, in the present embodiment, when the frame 5 is moved in the rearward right direction for stitching in the area δ, the lower thread extending from the rotary hook 3 toward the needle hole 19*a* abuts against the rear wall surface 52*a* of the recessed portion 52, and rightward movement of the lower thread is restricted by the upstream side wall 52*b*. Because the lower thread having moved out of the rotary hook 3 is directed to move to the needle hole 19*a* by way of the left of the up-and-down movement trajectory of the sewing needle 11, the needle drops to a position located to the right of the lower thread, and thus, it is possible to reduce occurrence of a hitch stitch.

For example, in a case where the stitching direction belongs to the area δ of FIG. 1 and the frame 5 is moved in a direction of about 70°, the path of the lower thread can be reliably caused to be located to the left of the needle drop position (the up-and-down movement trajectory of the sewing needle 11). Thus, in this case, even if the position of the rear wall surface 52*a* of the recessed portion 52 is shallower than, namely located somewhat in front of, the above-mentioned substantial limit position, occurrence of a hitch stitch can be avoided. On the other hand, in a case where the frame 5 is moved, for example, in a direction of about 40° and if the position of the rear wall surface 52*a* of the recessed portion 52 is shallower than the above-mentioned substantial limit position, the path of the lower thread is located to the right, rather than to the left, of the needle drop position (the up-and-down movement trajectory of the sewing needle 11) by way of the front of the movement trajectory, and thus, occurrence of a hitch stitch cannot be avoided. However, by setting the position of the rear wall surface 52*a* of the recessed portion 52 at the above-mentioned substantial limit position, the path of the lower thread can be caused to be located to the left of the needle drop position (the up-and-down movement trajectory of the sewing needle 11) in such a manner as to avoid occurrence of a hitch stitch, even in the case where the frame 5 is moved, for example, in the direction of about 40°. Namely, by setting the position of the rear wall surface 52*a* more rearward, it is possible to expand the area in which occurrence of a hitch stitch can be avoided by the construction of the rotary hook employed in the present embodiment. Further, by positioning the rear wall surface 52*a* at the above-mentioned substantial limit position, it is possible to maximize the area for which detour control (detouring movement control) of the frame is not required.

Preferably, a construction for locking the lower thread at the time of thread cutting may be provided on the downstream side wall 52*c* of the recessed portion 52. As illustrated in FIG. 12, the downstream side wall 52*c* projects forward more than the upstream side wall 52*b* and has a projecting part 52*d* formed at its front end. A thread cutting device (not illustrated) is provided above the rotary hook 3 as known in the art. When a thread cutting operation is to be performed by the thread cutting device, a portion of the lower thread extending from the rotary hook 3 toward the needle hole 19*a* is captured and guided leftward to a cutting position where the portion of the lower thread is cut by the cutting device. When the lower thread is moved leftward for such a thread cutting operation as noted above, the lower thread abuts against the downstream side wall 52*c* in such a manner that it is movable in the front-rear direction along the downstream side wall 52*c* as appropriate. If the front edge of the downstream side wall 52*c* is in the same plane as the front surface of the side wall, the lower thread may undesirably easily come off the front edge of the downstream side wall 52*c*. In such a case, the lower thread reaches the thread cutting device after having moved a shorter distance from the rotary hook 3; if the lower thread is cut by the cutting device in such a state, the length of the lower thread remaining after the cutting becomes shorter, and some problem or inconvenience may occur in a next operation. In order to avoid such an inconvenience, the above-mentioned projecting part 52*d* is provided at the front end of the downstream side wall 52*c* in such a manner as to somewhat project beyond the front surface of the side wall 52*c*. Thus, when the lower thread abutting against the downstream side wall 52*c* moves forward during the thread cutting operation, the lower thread is engaged by the projecting part 52*d* and thus is prevented from coming off the front edge of the downstream side wall 52*c*. With such arrangements, it is possible to ensure or secure a necessary and sufficient remaining length of the lower thread after the cutting operation and prevent a problem or inconvenience from occurring in the next operation.

Next, a description will be given about examples of further improvements of the inner rotary hook 50 and the outer rotary hook 60. As known in the art, the outer rotary hook 60 has, on its outer periphery, the hook point 61 for capturing a loop of the upper thread pulled out of the eye hole 11*a* of the sewing needle 11. Further, a thread dividing spring (i.e., upper spring part) 62 is fixed to the outer peripheral surface of the outer rotary hook 60 by use of a screw. A distal end portion 62*a* of the thread dividing spring 62 is formed in a claw shape for guiding the upper thread loop captured by the hook point 61. Further, the front end edge (i.e., front side edge) 62*b* of the thread dividing spring 62 is formed to be located behind the rear wall surface 52*a* of the recessed portion 52 in the inner rotary hook 50, as illustrated in FIG. 13(*b*). In other words, the front end edge 62*b* of the thread dividing spring 62 is formed so as not to project forward beyond the front side edge (i.e., side edge located in front of the movement trajectory) of the hook point 61 of the outer rotary hook 60.

The conventionally known thread dividing spring is shaped to have a projecting portion (fin portion) which extends in the rotating direction of the outer rotary hook and whose front edge end projects forward for pushing forward the upper thread loop captured in response to the rotation of the outer rotary hook. With the front edge end of the thread dividing spring projecting forward like this, the lower thread, directed from the rotary hook toward the needle hole, is also pushed forward, and thus, slackness may occur in the lower thread.

By contrast, in the present embodiment, no such projecting portion (fin portion) is formed on the front end edge 62*b* of the thread dividing spring 62, therefore, the thread dividing spring 62 does not contact the lower thread guided by the recessed portion 52 and thus slackness does not occur in the lower thread. Namely, in the present embodiment, the thread dividing spring 62 does not push forward the upper thread loop, and thus, the thread dividing spring 62 is referred to more generically as "upper spring part".

Instead of providing a projecting (fin) portion on the front end edge 62*b* of the thread dividing spring (upper spring part) 62, the inner rotary hook 50 in the present embodiment has an improved construction as described hereinbelow. As illustrated in FIG. 11, FIG. 13(*a*), and the like, a raised portion 53 protruding forward is formed on a front outer peripheral surface of the inner rotary hook 50 over a range of about one-quarter arcuate angle (i.e., 90°), particularly over a range less than one-quarter arcuate angle (i.e., 90°), and more particularly, as in the illustrated example, over a range of about 80° from the recessed portion 52 downstream in the rotating direction of the rotary hook. More specifically, the raised portion 53, which has a generally mountain-like sectional shape, has a guide surface 53*a* slanting forward in such a manner that the slanting angle gradually increases in a downstream-to-upstream direction of the rotation of the rotary hook, and that a protruding height of the raised portion 53 gets smaller in an upstream-to-downstream direction of the rotation of the rotary hook. Such a protruding portion 53 functions to push forward the upper thread loop captured by the hook point 61 of the outer rotary hook 60. As the outer rotary hook 60 rotates, the upper thread loop is pushed forward while moving upward from below the raised portion 53 (in a rear-to-front direction)) and passes around the inner rotary hook 50 while moving along the front surface of the bobbin case 40. In this manner, the raised portion 53 of the inner rotary hook 50 can be caused to function as a substitute for the fin portion of the conventionally known thread dividing spring.

As denoted by two-dot chain lines in FIGS. 11 and 12, the rotary hook support 70 fixed to the rotary hook base 4 has a projection 71 that is fittable in the recessed portion 52 of the inner rotary hook 52. The inner rotary hook 50 is fixed to the rotary hook base 4 with the projection 71 fitted in the recessed portion 52 in such a manner that the inner rotary hook 50 is prevented from rotating together with the outer rotary hook 60. Further, with the projection 71 fitted in the recessed portion 52, a suitable hollow space is formed between the rear wall surface 52*a* of the recessed portion 52 and the distal end of the projection 71, and the lower thread guided to the recessed portion 52 passes through this hollow space to move on to the needle hole 19*a*.

Figure 14:
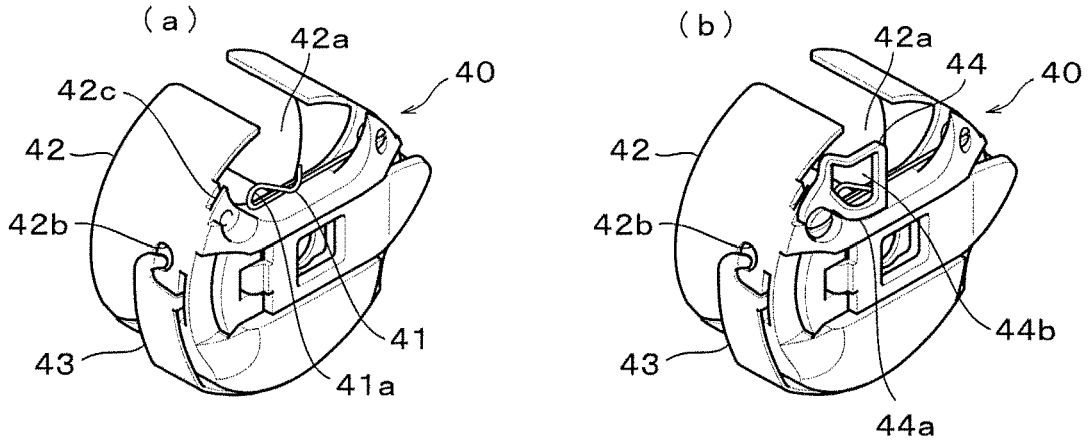
FIG. 14 is a perspective view illustrating an example of a bobbin case included in the rotary hook construction illustrated in FIG. 11.

Further, a description will be given about an example of the bobbin case 40 with reference to FIG. 14. Note that the lower thread bobbin housed within the bobbin case 40 is not illustrated in FIG. 14. As illustrated in FIG. 14(*a*), a body 42 of the bobbin case 40 has an opening 42*a* formed in its upper front surface portion for avoiding interference with the sewing needle 11 having dropped to the needle drop position. In a central part (central outer peripheral surface portion) of the bobbin case body 42, a pull-out hole 42*b* is formed for pulling out the lower thread from the lower thread bobbin housed within the bobbin case. Further, on the outer peripheral surface portion of the bobbin case body 42, a thread tension spring 43 is mounted for imparting constant tension to the lower thread. Furthermore, a guide groove 42*c* for regulating a passing position of the lower thread is formed above the pull-out hole 42*b*. An upper portion of the central part of the bobbin case body 42 is also open, and this upper opening of the central part of the bobbin case body 42 is in communication with the above-mentioned opening 42*a*.

The thread take-up member 41 is provided on an upper front surface portion of the bobbin case 40, and more specifically, the thread take-up member 41 is located at a position beneath the opening 42*a* and deviated a little to the left of the bobbin case 40. As a preferred example, the thread take-up member 41 is in the form of a spring so as to impart tension to the lower thread paid out from the lower thread bobbin and directed toward the hollow space of the recessed portion 52. For this reason, the thread take-up member 41 will hereinafter be referred to also as "thread take-up spring". The thread take-up spring (thread take-up member) 41 has a ring portion 41*a* of an annular or curved shape for passing therethrough (or catching) the lower thread paid out from the lower thread bobbin, and the lower thread passed through the ring portion 41*a* is directed toward the hollow space of the recessed portion 52 of the inner rotary hook 50. The tension imparted by the thread take-up spring 41 functions to not only appropriately guide the lower thread, which is on its way to the needle hole 19*a*, to pass through the recessed portion 52 (i.e., regulates the path of the lower thread so as to pass through the recessed portion 52) but also absorb slackness occurring in the lower thread. The thread take-up spring 41, which extends generally horizontally on and along the front surface of the bobbin case 40, is fixed at one end (right end), opposite from the above-mentioned ring portion 41*a*, to the bobbin case 40, and the ring portion 41*a* constitutes a free end of the thread take-up spring 41. The ring portion 41*a* is located substantially immediately below the recessed portion 52 of the inner rotary hook 50 and is swingable in the up-down and left-right directions by resilient restoring force of the spring in response to movement of the lower thread passed through the ring portion 41*a*. In one implementation, a length from the fixed end (right end) of the thread take-up spring 41 to the other end adjoining the ring portion 41*a* (left end) is relatively long as illustrated in the figures. Thus, a swing range (stroke range) of the thread take-up spring 41 can be made relatively large, so that relatively large slackness of the lower thread can be absorbed. The thread take-up member 41 constituted by a spring member as set forth above can not only function to reliably guide the lower thread toward the recessed portion 52 of the inner rotary hook 50 but also function to prevent slackness of the lower thread under various conditions by imparting tension to the lower thread.

The lower thread pulled out of the pull-out hole 42*b* of the bobbin case 40 abuts against the thread tension spring 43, passes through the guide groove 42*c*, passes through the ring portion 41*a* of the thread take-up lever 41 to move upward, then passes through the recessed portion 52 of the inner rotary hook 50, and then moves out of the rotary hook toward the needle hole 19*a*. However, the present invention is not so limited, and the lower thread pulled out of the pull-out hole 42*b* of the bobbin case 40 may be passed through the ring portion 41*a* of the thread take-up spring 41 by way of the thread tension spring 43 without being passed through the guide groove 42*c*.

As an option, a guide member 44 may be provided in the bobbin case 40 in front of the thread take-up spring (thread take-up member) 41 as shown in FIG. 14(*b*). The guide member 44 is removably mounted by a screw to an upper front left surface portion of the bobbin case body 42. The guide member 44 has a guide surface 44*a* protruding forward from its mounted position, and this guide surface 44*a* is formed to connect generally continuously to the front surface of the bobbin case 40 (i.e., extend in the substantially same plane as the front surface of the bobbin case 40). By the provision of such a guide member 44, the upper thread loop, moving to the front surface of the bobbin case 40 and then moving upward along the front surface as the rotary hook 3 rotates, can be guided smoothly along the front surface of the bobbin case 40.

Further, the guide member 44 has an opening 44*b* formed in the guide surface 44*a* so as to extend through the guide member 44 in the front-rear direction in such a manner as to enable a distal end of a picker of a well-known construction (not illustrated) to be inserted therein. The well-known picker is a member that, at the time of cutting of the upper thread by a thread cutting device (not illustrated), holds a portion of the upper thread on the sewing needle and thereby ensures a predetermined remaining length of the upper thread so as to prevent the upper thread from slipping out of the eye hole of the sewing needle. The well-known picker has a pair of left and right distal end portions, and at the time of the thread cutting operation, the two distal end portions are inserted into the opening 42*a* of the bobbin case 40 to catch and hold the upper thread, passing through the rotary hook 3, and thereby ensure a predetermined (after-cutting) remaining length of the upper thread, so that the upper thread can be prevented from slipping out of the eye hole of the sewing needle. Such a picker can be applied to the present embodiment, too. In the picker (not illustrated) to be applied to the present embodiment, one of the picker's distal end portions must be formed into a length somewhat shorter than that of the conventionally known picker in order to prevent interference to the thread take-up spring 41. The guide surface 44*a* and the opening 44*b* of the guide member 44 provide a construction suited for such a special picker. Namely, with the picker set at a predetermined position in the present embodiment, the shorter distal end portion (the left distal end portion) of the picker enters the opening 44*b* in the guide surface 44*a* of the guide member 44 but does not abut against the thread take-up spring 41. Thus, when the upper thread loop moves upward along the guide surface 44*a* of the guide member 44 protruding forward of the thread take-up spring 41, the upper thread loop is reliably caught on the two distal end portions (i.e., caught on the shorter distal end portion as well) of the picker; in this way, it is possible to ensure a predetermined remaining length of the upper thread and thereby prevent the upper thread from slipping out of the eye hole 11*a* of the sewing needle 11. Note that such a guide member 44 is not necessarily essential and may be dispensed with if the sewing machine is of a type that does not include a picker.

<Frame Detour Control>

Figure 15:
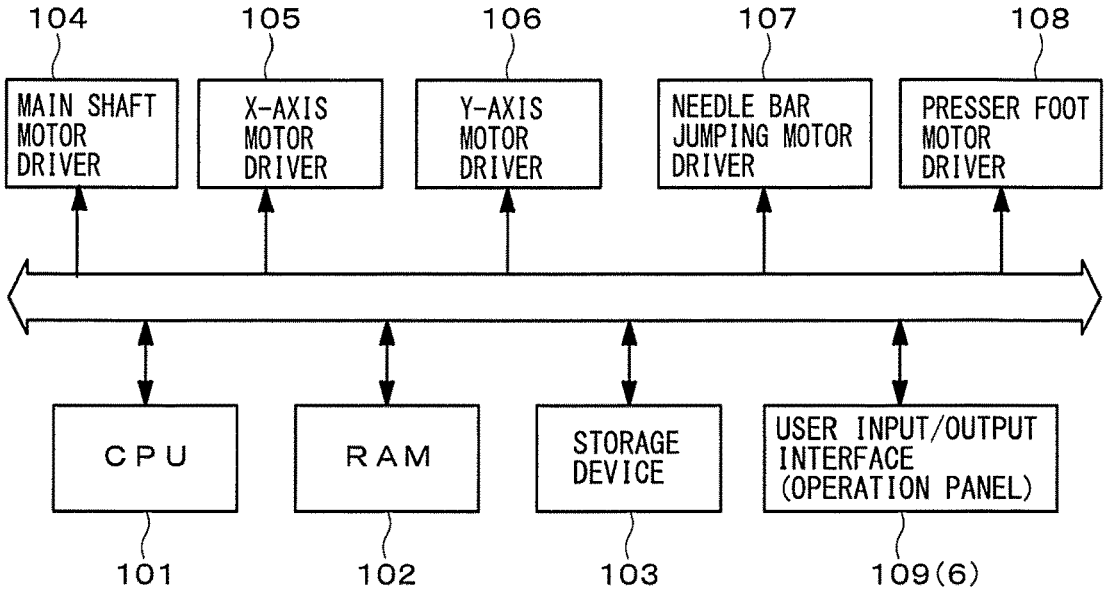
FIG. 15 is a block diagram illustrating an example of a control system of the sewing machine.

In the present embodiment, in order to avoid occurrence of a hitch stitch due to the behavior of the upper thread, not only the guide member 23 is provided in the presser foot device 21 as set forth above, but also detour control of the frame 5 (frame detour control) is performed. This frame detour control is performed by an electric/electronic control system. FIG. 15 is a block diagram illustrating an example of a control system (i.e., control device or controller) of the inventive sewing machine. As known, this control system includes: a CPU (Central Processing Unit) 102 that controls various processing and driving operations of the sewing machine; a RAM (Random Access Memory) 102 that is a working area of the CPU 101; and a storage device 103 (ROM or Read-Only Memory and/or a readable/writable memory, such as a flash memory or a hard disk) that has prestored therein in a non-volatile manner pre-programmed embroidery data (sewing data) of one or more patterns, program control data related to such embroidery data (sewing data), and various processing programs and data. The control system further includes: a driver 104 for the main shaft motor for rotating the main shaft 13; drivers 105 and 106 for X-axis and Y-axis motors for respectively moving the frame 5 in X-axis and Y-axis directions; a driver 107 for the jump motor for jumping the needle bar 9; and a driver 108 for the fabric pressing motor 24 for moving the presser foot device 21 up and down. The individual drivers are connected to the respective motors. The control system further includes an input/output interface 109 including the above-mentioned operation panel 6. The operation panel 6 is in the form of a touch panel for displaying images and receiving user's input operations as noted above, and various setting and controlling screens are displayed on the touch panel. A user of the sewing machine can perform various operations and make various settings by, for example, touching images and the like displayed on the screen of the touch panel. Further, the control system may include a communication interface (not illustrated) for communication with external devices and/or internal or external communication networks.

As known in the art, the sewing data of a desired pattern selected by the user are read out from the storage device 103 under the control of the CPU 101 and the drivers 104 to 108 and the like are controlled in accordance with the stitch-by-stitch sewing data, so that a sewing operation is performed to form stitches in a sequential manner. On the basis of the sewing data, a determination can be made as to whether or not a direction in which a next stitch is to be formed, namely a next-stitch forming direction, belongs to any one of the predetermined hitch-stitch forming (occurring areas) (for example, areas β to δ illustrated in FIG. 1). This determination can be made by the CPU 101 executing a predetermined program. Namely, the CPU 101 and the predetermined program function as determination means that determines, on the basis of the sewing data read out from the storage device 103, whether or not a direction in which a next stitch is to be formed, namely a next-stitch forming direction, belongs to any one of the predetermined hitch-stitch forming areas.

In the present embodiment, upon determination that the next-stitch forming direction belongs to any one of the predetermined hitch-stitch forming areas, detour control for moving the frame 5 in a detouring manner is performed when the frame 5 is to be moved to a target position corresponding to the next stitch, in order to avoid occurrence of a hitch stitch due to the behavior of the upper thread. Such detour control can be performed by a given program executed by the CPU 101. Namely, the CPU 101 and the given program function as means (i.e., detour control means) that, upon determination by the determination means that the next stitch forming direction belongs to any one of the predetermined hitch-stitch forming areas, performs the jump control via the jump mechanism (driver 107 and the like) and performs the detour control of the frame 5 by activating the aforementioned feed mechanism (drivers 105, 106 and the like) to perform detouring movement of the frame 5. Here, the detouring movement of the frame 5 includes moving, with the sewing needle 11 jumped upward to a predetermined upper position, the frame 5 in a particular direction such that the upper thread extending downward from the sewing needle 11 moves out of the opening section 29 of the guide member 23 of the presser foot device 21 and then further moving the frame 5 to the target position corresponding to the next stitch in such a manner that the upper thread, having moved out of the opening section 29, abuts against the restricting section 23*a*. Such movement of the frame 5 that causes the upper thread, having moved out of the opening section 29, to abut against the restricting section 23*a* of the guide member 23 is nothing but detouring movement of the upper thread where the upper thread, having moved out of the opening section 29, takes such a detour as to go by way of the restricting section 23*a*. Namely, the detouring movement is such movement where, with the sewing needle 11 jumped upward, the frame 5 is temporarily moved in such a direction as to cause the upper thread to move out of the opening section 29, then caused to take a detour such that the upper thread, having moved out of the opening section 29, abuts against (i.e., goes by way of) the restricting section 23*a* and finally moved to reach the target position corresponding to the next stitch, instead of the frame 5 being moved directly to the target position corresponding to the next stitch.

Figure 16:
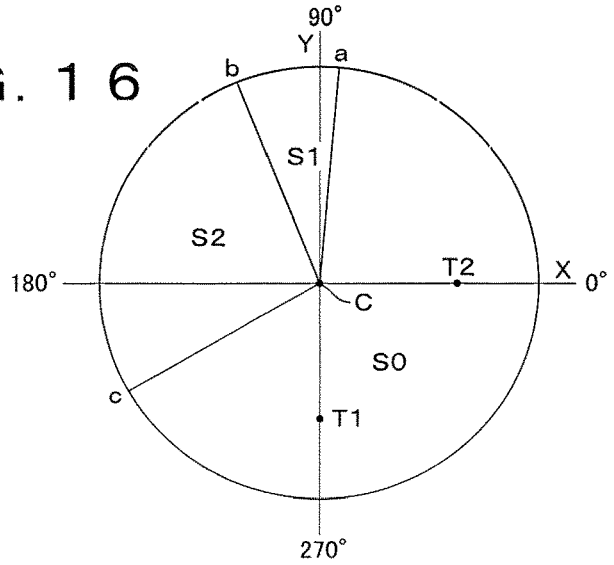
FIG. 16 is a diagram illustrating an example of areas for which detouring movement of a frame is performed for avoiding occurrence of a hitch stitch due to behavior of an upper thread.

As illustrated as the typical example in FIG. 1, the areas to which the stitching directions in which hitch stitches are formed (occur) due to the behavior of the upper thread belong are the areas β and γ. Of the area β, a partial area around 90° (i.e., an area in which the stitching directions are toward the rear of the sewing machine) is an area in which occurrence of hitch stitch formation can be avoided by causing the frame 5 to make detouring movement of a relatively small detour amount, and this partial area will hereinafter be referred to as "first area S1" for convenience sake. As a reference, an example of the first area S1 is illustrated in FIG. 16. In FIG. 16, the base point C located at the center of the diagram represents a current needle drop position (i.e., current position of the eye hole 19*a* of the needle plate 19) as in FIG. 1, and let it be assumed that a stitching direction from the base point C to a next needle drop position (i.e., next-stitch forming direction) is identified by an angle within a range from 0° to less than 360° calibrated in the counterclockwise direction. Moving directions of the frame 5 corresponding to the first area S1 of the stitching directions around 90° belong to an area around 270° that is exactly opposite (180 degrees opposite) to the first area S1. As a reference, an example of a movement target position of the frame 5 corresponding to a stitch in a stitching direction belonging to the first area S1 is denoted by T1 in FIG. 16. As may be seen from the figure, the target position T1 corresponding to the next stitch is relatively near the position to which frame 5 has been temporarily moved, at the time of the detouring movement, in such a direction as to cause the upper thread to move out of the opening section 29 of the guide member 23 (i.e., toward the front left). Therefore, the target position T1 can be reached by the frame 5 being caused to make a relatively small amount of detouring movement. In FIG. 16, the first area S1 is illustrated as having a range from angle a to angle b, for example, from 85° to less than 112°; however, such a range of the first area S1 may be variably set as appropriate as will be described later.

The remaining partial area of the areas β and γ to which the stitching directions in which hitch stitches are formed due to the behavior of the upper thread belong is an area in which occurrence of hitch stitch formation is avoided by causing the frame 5 to make detouring movement of a relatively large detour amount. This partial area will hereinafter be referred to as "second area S2" for convenience sake. This second area S2 includes the remaining portion of the area β and the entirety of the area γ illustrated in FIG. 1. Moving directions of the frame 5 corresponding to the second area S2 belong to an area that is exactly opposite (180 degrees opposite) to the second area S2. An example of a movement target position of the frame 5 corresponding to a stitch of a stitching direction belonging to the second area S2 is denoted by T2 in FIG. 16. As may be seen from the figure, at the time of the detouring movement of the frame 5, the target position T2 corresponding to the next stitch is relatively far from the position to which the frame 5 has been temporarily moved in such a direction as to cause the upper thread to move out of the opening section 29 of the guide member 23 (i.e., toward the front left), and this target position T2 tends to be near the rear of the sewing machine. Therefore, in order to reach the target position T2, it is necessary for the frame 5 to make detouring movement of a relatively large detour amount. In FIG. 16, the second area S2 is illustrated as having a range from angle b to angle c, for example, from about 112° to about 210°; however, such a rang of the second area S2, too, may be variably set as appropriate as will be described later. Note that the areas for which the detour amount of the frame 5 differs are not limited to the above-mentioned two areas S1 and S2 and may be three or more areas. Further, in FIG. 16, reference character S0 denotes an area for which no detouring movement of the frame 5 is performed, and the areas α and δ illustrated in FIG. 1 are included in this area S0.

In one embodiment of the present invention, the aforementioned control means may perform the above-mentioned jump control once (i.e., one time), two times or more during the detouring movement of the frame 5. In one implementation, in a case where the next-stitch forming direction belongs to the above-mentioned first area S1, the control means performs the jump control once (one time) during the detouring movement. Further, in a case where the next-stitch forming direction belongs to the above-mentioned second area S2, the control means performs the jump control two times during the detouring movement.

Figure 17:
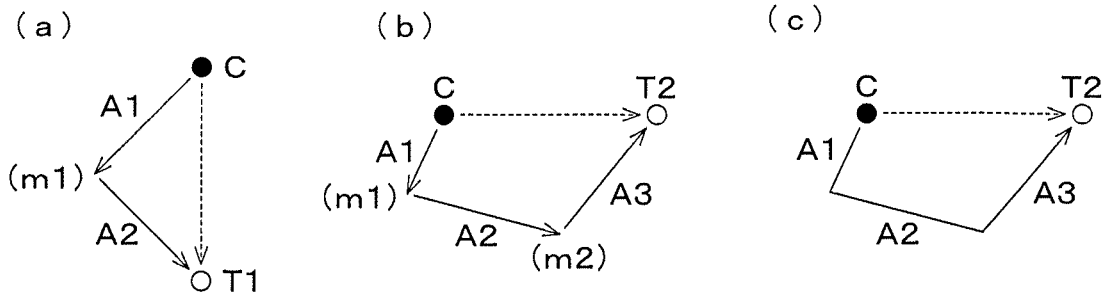
FIG. 17 is a diagram illustrating trajectories of the detouring movement of the frame.
Figure 18:
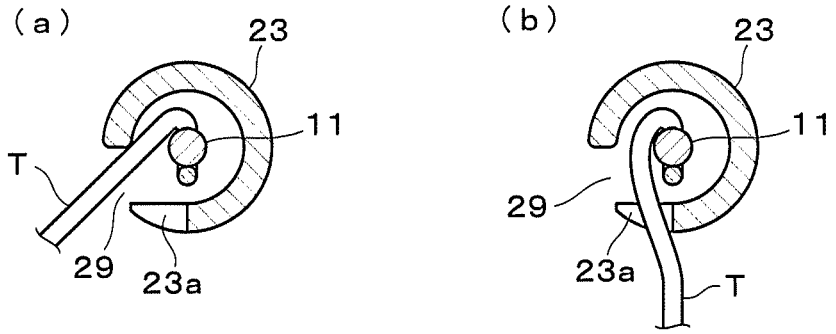
FIG. 18 is a sectional plan view illustrating relationships between the upper thread and the guide member of the presser foot device during the detouring movement of the frame.

FIG. 17 is a diagram illustrating several trajectories of the detouring movement of the frame 5 performed by the frame detour control by the control means. In FIG. 17, as in FIG. 16, reference character C denotes a (current) needle drop position (base point) at the beginning of the detouring movement, and reference characters T1 and T2 denote needle drop positions (target positions) at the end of the detouring movement. FIG. 18 is a sectional plan view illustrating relationships between the upper thread T and the guide member 23 of the presser foot device 21 during the detouring movement of the frame 5 and more particularly illustrating in a horizontal sectional view the guide member 23, the sewing needle 11, and a portion of the upper thread T entering the eye hole 11*a* of the sewing needle 11. Note, however, that because the sewing needle 11 in the jumped state is located at a position higher than the guide member 23, the respective sections of the guide member 23 and the sewing needle 11 (and the section of the portion of the upper thread T entering the eye hole 11*a*) are not at the same height.

FIG. 17(*a*) illustrates a trajectory of the detouring movement in the case where the next-stitch forming direction belongs to the aforementioned first area S1; in this case, the jump control is performed once during the detouring movement. The needle bar 9 (and hence the sewing needle 11) having moved upward at the base point C is set in the jumped state to be held at the upper position by the jump mechanism. Further, the fabric pressing motor 24 is deactuated, and the presser foot device 21 is stopped at a predetermined upper position. Simultaneously, the frame 5 is controlled to move in such a direction as to cause the upper thread T, extending downward from the sewing needle 11, to move out of the opening section 29 of the guide member 23. The movement of the frame 5 at that time is denoted by A1 in FIG. 17(*a*). An end point of the movement A1 (i.e., a mid-point m1 of the detouring movement) of the frame 5 may be set as an appropriate X-Y coordinate value. In order to perform the detouring movement of the frame 5 in an efficient (compact) manner, the end point of the movement A1 of the frame 5 may be set in such a manner that the movement A1 is executed in a diagonally forward left direction as illustrated. However, the present embodiment is not so limited, and the end point of the movement A1 (i.e., the mid-point m1) of the frame 5 may be set in any other appropriate manner as long as such a modification does not depart from the scope and spirit of the present invention. FIG. 18(*a*) illustrates a state in which the upper thread T has moved out of the opening section 29 of the guide member 23 in the diagonally forward left direction in response to the movement A1 of the frame 5. Once the frame 5 reaches the mid-point m1, the jump control for one stitch is brought to an end.

Next, the frame 5 is moved from the mid-point m1 to the target position T1 corresponding to the next stitch. Such movement of the frame 5 is denoted by A2 in FIG. 17(*a*). The movement A2 of the frame 5 is executed in the diagonally forward right direction as illustrated, and during the course of the movement A2, the upper thread T, having moved out of the opening section 29 of the guide member 23, abuts against (or is received by) the restricting section 23*a* of the guide member 23, and thus, rightward movement of the upper thread T is restricted by the restricting section 23*a*. FIG. 18(*b*) illustrates the state in which the upper thread T has abutted against the restricting section 23*a* in response to the movement A2 of the frame 5. In this state, the upper thread T having moved out of the eye hole 11*a* of the sewing hole 11 is located to the left of the sewing needle 11. While the frame 5 is moving from the mid-point m1 toward the target position T1, the needle bar 9 (and the sewing needle 11) and the presser foot device 21 descend. Of course, appropriate operating time adjustment is made in such a manner that the frame 5 reaches the target position T1 to complete the detouring movement before the descending sewing needle 11 and presser foot device 21 contact the upper surface of the sewing workpiece.

FIG. 17(*b*) illustrates a trajectory of the detouring movement in the case where the next-stitch forming direction belongs to the second area S2; in this case, the jump control is performed two times (for two stitches) during the detouring movement of the frame 5. The needle bar 9 (and hence the sewing needle 11) having moved upward at the base point C is set in the jumped state and held at the upper position through the jump mechanism. Further, the fabric pressing motor 24 is de-actuated, and the presser foot device 21 is stopped at a predetermined upper position (top dead point). Simultaneously, the frame 5 is controlled to move in such a direction as to cause the upper thread T, extending downward from the sewing needle 11, to move out of the opening section 29 of the guide member 23. The movement of the frame 5 at that time is denoted by A1 in FIG. 17(*b*) as in FIG. 17(*a*). Similarly to the aforementioned, the end point of the movement A1 (i.e., the first mid-point m1 of the detouring movement) of the frame 5 may be set as an appropriate X-Y coordinate value. Similarly to the aforementioned, in order to perform the detouring movement of the frame 5 in an efficient (compact) manner, the end point of the movement A1 (i.e., the first mid-point m1) may be set in such a manner that the movement A1 of the frame 5 is executed in a diagonally forward left direction as illustrated. The state in which the upper thread T has moved out of the opening section 29 of the guide member 23 in the diagonally forward left direction in response to the movement A1 of the frame 5 is illustrated in FIG. 18(*a*). Although the first jump control for one stitch (first stitch) ends once the frame 5 reaches the first mid-point m1, the second jump control for another one stitch (second stitch) is performed immediately following the first jump control in order to keep the jumped state of the sewing needle 9 (the sewing needle 11).

Then, with the sewing needle 9 kept in the jumped state, the frame 5 is moved from the first mid-point m1 to a second mid-point m2. Such movement of the frame 5 is denoted by A2 in FIG. 17(*b*). The movement A2 of the frame 5 is executed in the diagonally forward right direction as illustrated, and during the course of the movement A2, the upper thread T, having moved out of the opening section 29 of the guide member 23, abuts against (or is received by) the restricting section 23*a* of the guide member 23, and thus, rightward movement of the upper thread T is restricted by the restricting section 23*a*. Such a state in which the upper thread T abuts against the restricting section 23*a* is similar to the state illustrated in FIG. 18(*b*). In this state, the upper thread T having moved out of the eye hole 11*a* of the sewing needle 11 is located to the left of the sewing needle 11. An end point of the movement A2 (i.e., the second mid-point m2) of the detouring movement of the frame 5 may be set as an appropriate X-Y coordinate value. In order to enable the upper thread T to reliably reach the target position T2 and to abut against (to be received by) the restricting section 23*a*, the end point of the movement A2 (i.e., the second mid-point m2) of the frame 5 may be set such that the movement A2 is executed in an appropriate diagonally forward right direction as illustrated. Once the frame 5 reaches the second mid-point m2, the second jump control is brought to an end. Note that when the frame 5 reached the end point of the movement A2 (the second mid-point m2), the upper thread T has been entwined counterclockwise around the restricting portion 23*a*.

Then, the frame 5 is moved from the second mid-point m2 toward the target position T2 corresponding to the next stitch. Such movement of the frame 5 is denoted by A3 in FIG. 17(*b*) and is executed in the diagonally rearward right direction as illustrated. In response to the movement A3 of the frame 5, the upper thread T is further entwined counterclockwise around the restricting section 23*a* to move further in the diagonally rearward right direction. However, the upper thread T having moved out of the eye hole 11*a* of the sewing needle 11 is still located to the left of the sewing needle 11, as in the state illustrated in FIG. 18(*b*). While the frame 5 is moving from the second mid-point m2 toward the target position T2, the needle bar 9 (and hence the sewing needle 11) and the presser foot device 21 descend. Similarly to the aforementioned, appropriate operating time adjustment is made in such a manner that the frame 5 reaches the target position T12 to complete the detouring movement before the descending sewing needle 11 and presser foot device 21 contact the upper surface of the sewing workpiece.

In the above-described frame detour control illustrated in FIGS. 17(*a*) and (*b*), the detouring movement of the frame 5 is performed in an intermittent manner. For example, stitch-by-stitch sewing data (frame moving data) and jump control codes may be pre-programmed in combination, and the detouring movement by the one-time jump control may be performed on the basis of a combination of the sewing data of the first one stitch (i.e., frame moving data for moving the frame 5 to the mid-point m1) and the jump control code and the sewing data of the next one stitch (frame moving data for moving the frame 5 to the target position T1). Further, the detouring movement by the two-time jump control may be performed on the basis of a combination of the sewing data of the first one stitch (frame moving data for moving the frame 5 to the mid-point m1) and the jump control code, a combination of the sewing data of the next one stitch (frame moving data for moving the frame to the second mid-point m2) and the jump control code, and the sewing data of the last one stitch (frame moving data for moving the frame 5 to the target position T2). Note that the number of times the jump control is performed in the frame detour control is not limited to one or two as noted above and may be three or more or only one.

The detouring movement of the frame 5 may be performed continuously rather than intermittently as noted above. FIG. 17(*c*) illustrates an example in which the detouring movement of the frame 5 is performed continuously. In the example of FIG. 17(*c*), the target position is denoted by T2 as in FIG. 17(*b*), and the detouring movement of the frame 5 is performed continuously along the trajectories A1, A2, and A3 as in FIG. 17(*b*). For example, a parameter prescribing that the frame 5 is to be moved continuously when the jump control codes are read out successively, and the detouring movement of the frame 5 to the target position T2 may be performed continuously on the basis of such a parameter with the needle bar 9 kept in the jumped state.

<Prevention of Upper Thread Slackening>

In one embodiment of the present invention, it is preferable to take measures for preventing slackening of the upper thread during the detouring movement control (or detour control) of the frame 5. For that purpose, an upper thread slackening preventing section 200 is provided in a lower portion of the needle bar case 8. Such an upper thread slackening preventing section 200 is disposed above an upper thread locking device 400 of a well-known construction, and opposite end portions of a base plate 201 of the slackening preventing section 200 are fixed by screws to brackets that are mounted to left and right side surfaces of the needle bar case 8. Pressing pieces 203 are fastened to positions of the base plate 201, which correspond to the individual needle bars 9, by screws 202 each having a spring fitted over its stem portion. The upper surface T (not illustrated in FIG. 3) hanging down from the thread take-up lever 10 is passed between the base plate 201 and the pressing piece 203. Thus, by adjusting a screw-in amount of the screw 202 to vary the resiliency of the spring, slight tension is imparted by contact resistance to the upper thread T passing between the base plate 201 and the pressing piece 203. The upper thread T having passed through the upper thread slackening preventing section 200 is passed through the upper thread locking device 400 and then passed through the eye hole 11*a* of the corresponding sewing needle 11. The tension imparted to the upper thread T by the screw 202 and pressing piece 203 of the upper thread slackening preventing section 200 may be of such a strength that can prevent the upper thread T, having been caught on (entwined around) the guide member 23 at the time of the detouring movement control of the frame 5, from undesirably slipping down from the guide member 23 due to its slackening. With the above-described upper thread slackening preventing section 200, even if slackening occurs in a portion of the upper thread T located above the preventing section 200 at the time of the descending of the thread take-up lever 10 that moves up and down even during the jumping of the needle bar 9, slackening that may occur in a portion of the upper thread T located below the preventing section 200 can be avoided by the contact resistance in the preventing section 200. Thus, it is possible to prevent the upper thread T, caught on (entwined around) the guide member 23 during the detouring movement control of the frame 5, from slipping down from the guide member 23 due to the slackness of the upper thread T. Note that the construction of the upper thread slackening preventing section 200 is not limited to the illustrated construction and may be any other suitable construction as long as it can prevent slackening of the upper thread T. Alternatively, the upper thread locking device 400 of the well-known construction may be used as a substitute for the upper thread slackening preventing section 200, without the upper thread slackening preventing section 200 being provided. Because the above-described upper thread slackening preventing section 200 constantly imparts tension to the upper thread T, even slight contact resistance might adversely influence tightness of stitches. Thus, as a modification of the invention, the upper thread slackening preventing section 200 may be constructed as a movable type, similarly to the upper thread locking device 400, in such a manner as to impart tension to the upper thread T only during the detouring movement control of the frame 5.

<Sewing Control for Achieving All Perfect Stitches>

Figure 19:
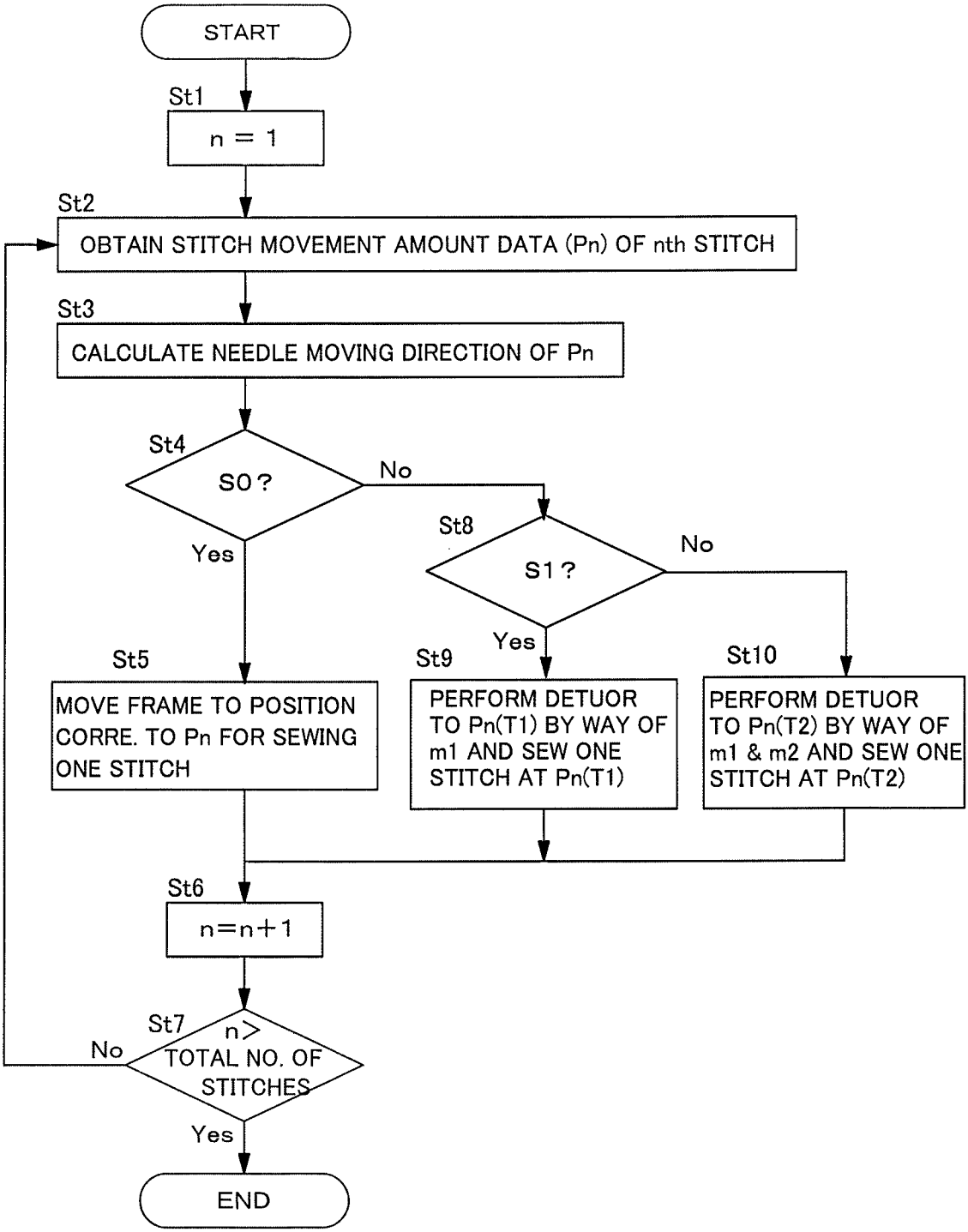
FIG. 19 is a flow chart illustrating an example of a computer program for performing sewing control to perform all-perfect-stitch sewing in accordance with an embodiment of the present invention.

The above-described sewing machine of the present invention can avoid occurrence of hitch stitches due to the behavior of the upper thread and lower thread and thereby achieve all-perfect-stitch sewing in which all stitches are formed as perfect stitches over the entire range of the stitching directions. FIG. 19 is a flow chart illustrating an example of a computer program for performing sewing control to achieve such all-perfect-stitch sewing in accordance with an embodiment of the present invention. This computer program is stored, for example, in the storage device 103 illustrated in FIG. 15 and executed by the CPU 101.

The computer program illustrated in FIG. 19 is started when a sewing operation is to be started for sewing a user-selected pattern (embroidery pattern or other sewing pattern) of a plurality of stitches. At step St1, a stitch counter n indicative of a particular position in a stitch formation order is set at an initial value of "1". At step St2, stitch movement amount data Pn (X-Y moving data of the frame 5) for forming a stitch of a particular position in the stitch formation order designated by a current value of the stitch counter n (i.e., nth stitch) is obtained. At next step St3, a needle moving direction (i.e., next-stitch forming direction) of the obtained stitch movement amount data Pn is calculated by using the current needle drop position as the base point C. At next step St4, a determination is made as to whether or not the calculated needle moving direction (next-stitch forming direction) belongs to the area S0 (for which the frame detour control is not to be performed) illustrated in FIG. 16. With a YES determination at step St4, the program goes to step St5, while with a NO determination, the program branches to step St8.

At step St5, a sewing operation for one stitch is performed by moving the frame 5 to a target position corresponding to the stitch movement amount data Pn and causing the needle bar 9 to descend. The detouring movement of the frame 5 is not performed in the sewing operation of step St5. As noted above, the area S0 illustrated in FIG. 16 includes the areas α and δ illustrated in FIG. 1. If the calculated needle moving direction (next-stitch forming direction) belongs to the area α, it is possible to form a perfect stitch by merely performing a normal sewing operation. If, on the other hand, the calculated needle moving direction (next-stitch forming direction) belongs to the area δ, it is possible to avoid occurrence of a hitch stitch due to the behavior of the lower thread and thereby form a perfect stitch by using the above-described unique rotary hook construction of the sewing machine of the present invention. Details of such perfect stitch formation will be given below.

<Avoidance of Hitch Stitch Occurrence in Area δ>

Figure 20:
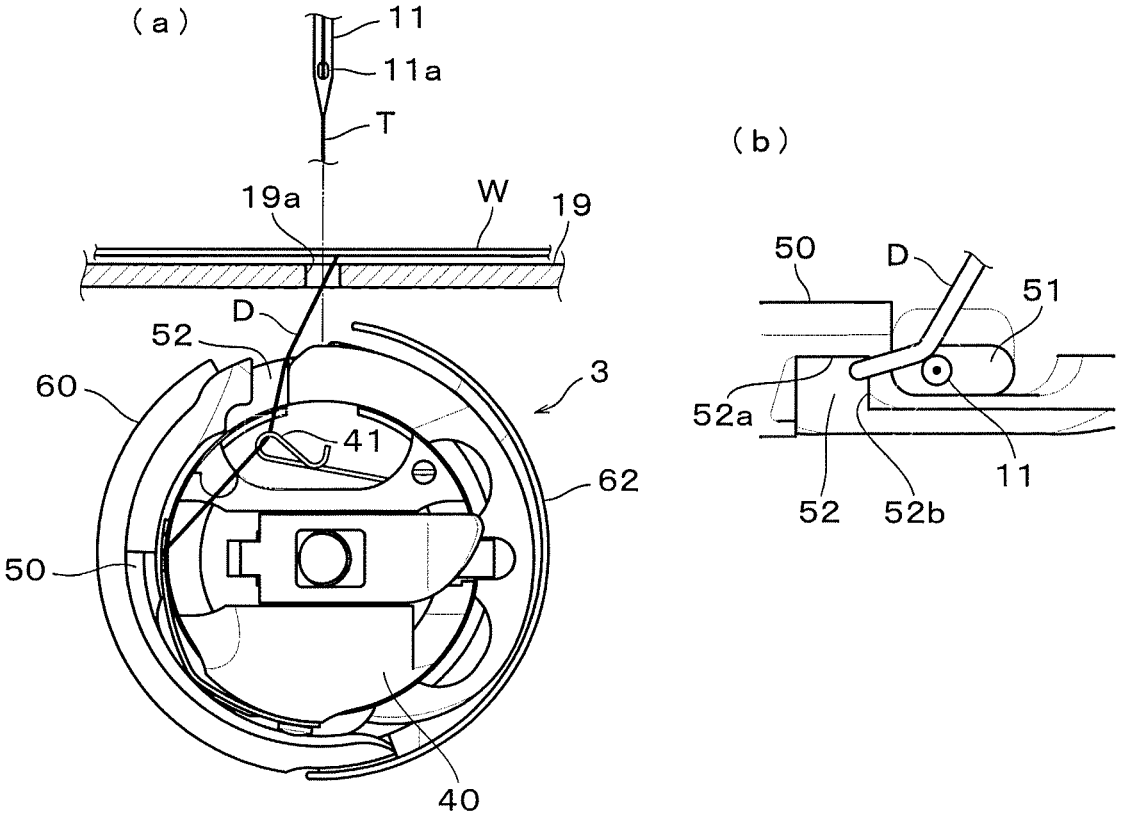
FIG. 20 is a view explanatory of a mechanism for, by use of the rotary hook construction, avoiding occurrence of a hitch stitch due to behavior of the lower thread in accordance with an embodiment of the present invention, of which (a) is a front view of the rotary hook construction and (b) is a top plan view illustrating at an enlarged scale a relationship between the sewing needle and the lower thread in the inner rotary hook.

FIG. 20 is a view explanatory of a mechanism for, by use of the rotary hook construction of the inventive sewing machine, avoiding occurrence of a hitch stitch due to the behavior of the lower thread, of which (a) is a front view of the rotary hook construction and (b) is a top plan view illustrating at an enlarged scale a relationship between the sewing needle and the lower thread in the inner rotary hook 50. Note that the rotary hook 3 illustrated in FIG. 20 is similar to the rotary hook 3 described above with reference to FIGS. 11 to 14. In the case where the next-stitch forming direction belongs to the area δ, the frame 5 is moved in the rearward right direction toward the target position corresponding to the next stitch. The lower thread D extending from the rotary hook 3 toward the needle hole 19*a* is pulled in the rearward right direction in response to the movement of the frame 5, during which time the lower thread D abuts against the rear wall surface 52*a* of the recessed portion 52 of the inner rotary hook 50 and the rightward movement of the lower thread D is restricted by the upstream side wall 52*b* of the recessed portion 52 as illustrated in FIGS. 20(*a*) and (*b*). The lower thread D having moved out of the rotary hook 3 moves toward the needle hole 19*a* by way of the rear left of the up-and-down movement trajectory of the sewing needle 11 and connects to the sewing workpiece W located above; thus, when the ascending/descending sewing needle 11 is located beneath the needle plate 19, the lower thread D is always located to the rear left (i.e., behind and to the left of) of the sewing needle 11 and never located to the right of the sewing needle 11. In this way, occurrence of a hitch stitch in the area δ due to the behavior of the lower thread D can be avoided structurally, and entwining between the upper thread T and lower thread D achieved in the rotary hook 3 can form a perfect stitch.

Note that when the sewing needle 11 passes through the sewing workpiece (fabric workpiece) W, the sewing workpiece may flutter in the up-down direction; thus, undesired slackening may occur in the lower thread D, and the slackened lower thread D may undesirably move rightward beyond the tip of the sewing needle 11. However, the thread take-up member 41 in the present embodiment performs a spring action as noted above; thus, even when the lower thread D has slackened due to the fluttering of the sewing workpiece W or the like, the spring action of the thread take-up member (thread take-up spring) 41 located substantially immediately below the recessed portion 52 of the inner rotary hook 50 quickly absorbs the slackness of the lower thread D. In this way, it is possible to keep the lower thread D in an appropriately taut state and thereby prevent the lower thread D from moving rightward beyond the tip of the sewing needle 11. Further, because the front end edge 62*b* of the upper spring part (thread dividing spring) 62 of the outer rotary hook 60 is located behind the rear wall surface 52*a* of the recessed portion 52 of the inner rotary hook 50 as noted above, the front end edge 62*b* does not push forward the lower thread D by abutting against the lower thread D. Thus, no slackening occurs in the lower thread D due to the behavior of the upper spring part (thread dividing spring) 62 of the outer rotary hook 60. In the above-described manner, the present embodiment takes all possible measures of eliminating a possibility of occurrence of a hitch stitch due to slackness of the lower thread D as well.

Referring now back to FIG. 19, at step St8, a further determination is made as to whether or not the needle moving direction (next-stitch forming direction) calculated at step St3 above belongs to the first area S1 (a part of the area β) illustrated in FIG. 16. With a YES determination at step St8, the program goes to step St9. At step St9, the frame detouring movement control for the first area S1 is performed by using a small or short detouring movement trajectory as illustrated in FIG. 17(*a*). A NO determination at step St8 means that the needle moving direction (next-stitch forming direction) calculated at step St3 above belongs to the second area S2 (i.e., the area including the remaining part of the area β and the area γ) illustrated in FIG. 16; in this case, the program goes to step St10 to perform the frame detouring movement control for the second area S2 by using a large or long detouring movement trajectory as illustrated in FIG. 17(*b*).

<Avoidance of Hitch Stitch Occurrence in Area S1>

Figure 21:
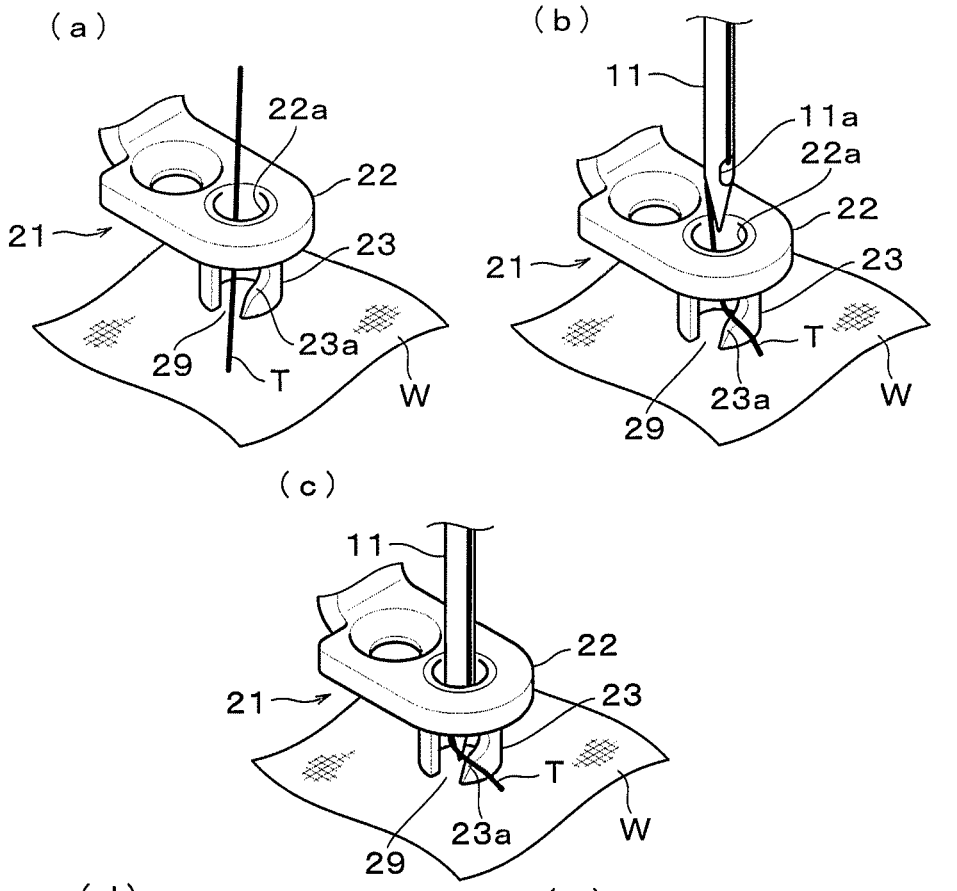
FIG. 21 is a perspective view explanatory of functions of the guide member of the presser foot device during the detouring movement control of the frame.

The frame detouring movement control for the first area S1 (one-time jump control) performed at step St9 includes moving the frame 5 to the mid-point m1 with the needle bar 9 kept in the jumped state, then moving the frame 5 to the target position T1, and dropping the sewing needle 11 onto the sewing workpiece W. Details of such control will be given below with reference to FIG. 21 as well. FIG. 21 is a perspective view explanatory of functions of the guide member 23 of the presser foot device 21 during the detouring movement control of the frame 5.

By moving the frame 5 to the mid-point m1 with the needle bar 9 kept jumped to hold the sewing needle 11 at the upper position, the frame 5 is moved as denoted by A1 in FIG. 17(*a*), and thus, the upper thread T is placed in a state where a portion of the thread T projects in the diagonally forward left direction out of the opening section 29 of the guide member 23 of the presser foot device 21 as illustrated in FIG. 18(*a*); FIG. 21(*a*) illustrates such a state of the upper thread T in a perspective view. Next, by moving the frame 5 from the mid-point m1 to the target position T1, the frame 5 is moved as denoted by the trajectory A2 of FIG. 17(*a*), and thus, the upper thread T is placed in a state where it abuts against (or is received by) the restricting section 23*a* of the guide member 23 to be restricted by the restricting section 23*a* as illustrated in FIG. 18(*b*). Simultaneously, the needle bar 9 is released from the jumped state, so that the sewing needle 11 and the presser foot device 21 descend.

FIG. 21(*b*) illustrates a state immediately before the descending sewing needle 11 enters the through-hole 22*a* formed in the pressing member 22 of the presser foot device 21. As seen from the figure, the upper thread T connecting to the sewing workpiece W from the rear portion of the eye hole 11*a* of the sewing needle 11 is caught on the restricting section 23*a* of the guide member 23 (more specifically, received in a recessed portion of the restricting section 23*a*), and thus, movement of the upper thread T rightward beyond the up-and-down movement trajectory of the sewing needle 11 is restricted by the restricting section 23*a*, so that the upper thread T is held located to the left of the sewing needle 11.

FIG. 21(*c*) illustrates a state in which the sewing needle 11 has further descended to enter the guide member 23 of the pressing member 22 immediately before the needle 11 pierces the sewing workpiece W. The sewing needle 11 descending within the guide member 23 passes by the right of a portion of the upper thread T having moved out from the rear portion of the eye hole 11*a* of the sewing needle 11 to connect to the sewing workpiece W while being restricted by the restricting section 23*a*. Once the guide member 23 of the presser foot device 21 reaches its bottom dead point, the descending movement of the presser foot device 21 is stopped, after which only the sewing needle 11 descends further.

FIG. 21(*d*) illustrates a state in which the tip of the further descending sewing needle 11 has sticked into the sewing workpiece W after having passed through the guide member 23. As the sewing needle 11 descends, the portion of the upper thread T, connecting to the sewing workpiece W from the rear portion of the eye hole 11*a* of the sewing needle 11, descends along the restricting section 23*a* while being kept located to the left of the sewing needle 11 by the rightward movement of the upper thread portion being restricted by the restricting section 23*a* of the guide member 23.

FIG. 21(*c*) illustrates a state in which the portion of the upper thread T, connecting to the sewing workpiece W from the rear portion of the eye hole 11*a* of the sewing needle 11, has reached a position beneath the lower end of the guide member 23 as the sewing needle 11 descends further. In this state, the portion of the upper thread T, connecting to the sewing workpiece W from the rear portion of the eye hole 11*a* of the sewing needle 11, is released from the restricting section 23*a* and starts to twine around the sewing needle 11 in the counterclockwise direction.

When the eye hole 11*a* of the further descending sewing needle 11 has reached a position below the needle plate 19 by the further descending sewing needle 11 passing through the sewing workpiece W and the needle hole 19*a* of the needle hole 19, the portion of the upper thread T, connecting to the sewing workpiece W from the rear portion of the eye hole 11*a* of the sewing needle 11, extends upward along the left side of the sewing needle 11 to reach the sewing workpiece W after passing through the needle hole 19*a* of the needle plate 19. In the state where the sewing needle 11 has descended to the rotary hook 3 in the aforementioned manner, the path of the upper thread T leading from the rear portion of the eye hole 11*a* to the sewing workpiece W (needle hole 19*a*) above, is held located to the left of the sewing needle 11. In the state where the sewing needle 11 has descended into the rotary hook 3, the upper thread T having moved out from the rear portion of the eye hole 11*a* to extend upward is captured by the hook point 61 of the outer rotary hook 60 and moved together with the hook point 61, so that a loop of the upper thread is formed (pulled out). Then, the upper thread loop is entwined with the lower thread D through a combination of the rotation of the rotary hook 3, ascending movement of the sewing needle 11, and movement of the thread take-up lever 10; in this manner, a stitch is formed. Because the upper thread T having moved out from the rear portion of the eye hole 11*a* enters the rotary hook 3 while being located to the left of the sewing needle 11 (entwined counterclockwise around the sewing needle 11), the above-mentioned stitch is formed as a perfect stitch. In the above-described manner, it is possible to avoid occurrence of a hitch stitch in the first area S1 (a part of the area β).

<Avoidance of Hitch Stitch Occurrence in Area S2>

Figure 22:
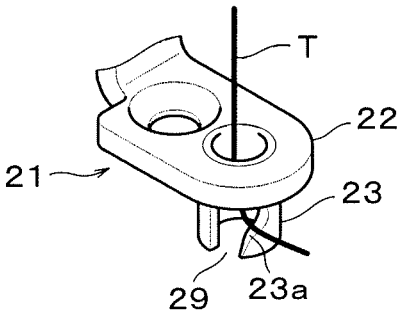
FIG. 22 is a perspective view explanatory of functions of the guide member of the presser foot device during the detouring movement control of the frame.

The frame detouring movement control for the second area S2 (two-time jump control) performed at step St10 includes moving the frame 5 to the first mid-point m1 with the needle bar 9 jumped for one stitch, then moving the frame 5 to the second mid-point m2 with the needle bar 9 jumped for another one stitch, and finally moving the frame 5 to the target position T2 and then causing the sewing needle 11 to drop onto the sewing workpiece W. Details of such control will be given below with reference to FIG. 21(*a*) and FIG. 22 as well.

By moving the frame 5 to the first mid-point m1 with the needle bar 9 jumped for one stitch to hold the sewing needle 11 at the upper position, the frame 5 is moved at denoted by A1 in FIG. 17(*b*), and the upper thread T, extending downward from the rear portion of the eye hole 11*a* of the sewing needle 11 held at the upper position, moves in the diagonally forward left direction out of the opening section 29 of the guide member 23 of the presser foot device 21 as illustrated in FIG. 18(*a*). Such a state is illustrated in the perspective view of FIG. 21(*a*).

Next, by moving the frame 5 from the first mid-point m1 to the second mid-point m2 with the needle bar 9 still kept jumped (jumped for another one stitch), the frame 5 is moved generally rightward as denoted by the trajectory A2 of FIG. 17(*b*). Once the frame 5 reaches the second mid-point m2, the jump control is brought to an end. When the end point of the movement A2 (i.e., second mid-point m2) has been reached, the upper thread T has been entwined around the restricting section 23*a* of the guide member 23 in the counterclockwise direction. Such a state is illustrated in the perspective view of FIG. 22. In this state, as seen from the figure, the upper thread T, extending downward from the sewing needle 11 to connect to the sewing workpiece W, has been deeply entwined around the restricting section 23*a* of the guide member 23 in the counterclockwise direction. Because the detouring movement of the frame 5 by the two-time jump control enables the upper thread T to be reliably entwined around or caught on the restricting section 23*a* in the aforementioned manner, it is possible to reliably prevent an upper thread entwining mistake.

Finally, by moving the frame 5 from the second mid-point m2 to the target position T2, the frame 5 is moved as denoted by the trajectory A3 of FIG. 17(*b*). In response to such movement A3, the upper thread T is further entwined around the restricting section 23*a* in the counterclockwise direction to go in the diagonally rearward right direction. In this manner, the upper thread T, extending from the rear portion of the eye hole 11*a* of the sewing needle 11 to the sewing workpiece W, is deeply entwined counterclockwise around the restricting section 23*a* of the guide member 23 and thus restricted from moving rightward beyond the up-and-down movement trajectory of the sewing needle 11, so that the upper thread T is held located to the left of the sewing needle 11. Because the jump control has already ended by that time, the needle bar 9 (and thence the sewing needle 11) and the presser foot device 21 descend while the frame 5 is being moved from the second mid-point m2 toward the target position T2.

During the course of the movement of the further descending sewing needle 11 to the rotary hook 3 through the sewing workpiece W and the needle hole 19*a*, the upper thread T is placed in various states similar to those described above with reference to FIGS. 21(*c*) to (*e*). Namely, the portion of the upper thread T, having moved out from the rear portion of the eye hole 11*a* of the sewing needle 11, enters the rotary hook 3 while being kept located to the left of the sewing needle 11 (entwined around the sewing needle 11 in the counterclockwise direction), and thus, it is possible to form stitches while avoiding occurrence of a hitch stitch due to the behavior of the upper thread. Particularly, in the remaining part of the area β of the second area S2, a perfect stitch is formed by avoiding occurrence of a hitch stitch due to the behavior of the upper thread as described above. In the area γ of the second area S2, a hitch stitch due to the behavior of the upper thread and a hitch stitch due to the behavior of the lower thread occur in a mixture. Thus; as for the area γ, it is not sufficient to only avoid occurrence of a hitch stitch due to the behavior of the upper thread, and it is necessary to avoid occurrence of a hitch stitch due to the behavior of the lower thread as well. More specifically, occurrence of a hitch stitch due to the behavior of the lower thread need be avoided; because, double hitch stitches occur if the lower thread is located behind the up-and-down movement trajectory of the sewing needle 11, even though the upper thread is entwined counterclockwise around the sewing needle 11 by the frame detour control. Occurrence of such a hitch stitch due to the behavior of the lower thread can be avoided by use of the unique needle plate construction related to the needle hole 19*a* of the needle plate 19, as described above. Details of such avoidance of a hitch stitch due to the behavior of the lower thread will be given below.

<Avoidance of Hitch Stitch Occurrence in Area γ Due to Behavior of Lower Thread>

Figure 23:
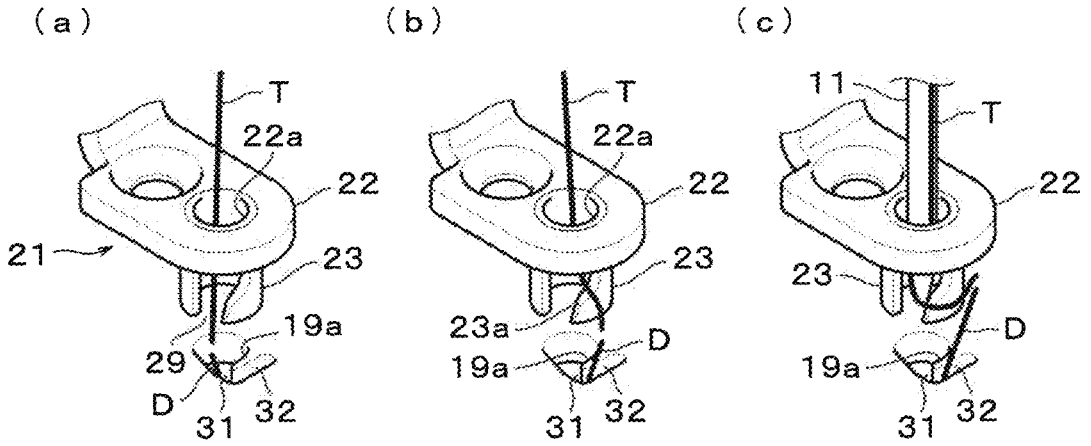
FIG. 23 is a perspective view illustrating a mechanism for, by use of the needle plate construction illustrated in FIGS. 9 and 10, avoiding occurrence of a hitch stitch.

As described above with reference of FIGS. 9, 10 and other figures, the needle plate 19 has the guide hole 31 and the groove portion 32 formed therein in relation to the needle hole 19*a*. FIG. 23 is a perspective view illustrating a mechanism for, by use of the construction of the needle plate 19 having the guide hole 31 and the groove portion 32, avoiding occurrence of a hitch stitch due to the behavior of the lower thread. To ease understanding of the figure, illustration of the frame 5 and the sewing workpiece W present between the presser foot device 21 and the needle plate 19 is omitted in the figure, and accordingly, illustration of a lower portion of the upper thread T and an upper portion of the lower thread D is also omitted in the figure. Further, a distance between guide member 23 of the presser foot device 21 and the needle plate 19 (needle hole 19*a*) is illustrated as if it is constant for convenience sake; actually, however, this distance varies as the presser foot device 21 moves up and down.

FIG. 23(*a*) illustrates a state when the frame 5 has been moved almost to the first mid-point m1 (in the diagonally forward left direction) in the frame detouring movement control (two-time jump control) for the second area S2 performed at step St10. In this state, the upper thread T, extending downward from the rear portion of the eye hole 11*a* of the sewing needle 11 located at the upper position, has moved in the diagonally forward left direction out of the opening section 29 of the guide member 23 of the presser foot device 21 as noted above. The lower thread D, extending upward from the rotary hook 3 to connect to the sewing workpiece W, has been passed through the needle hole 19*a* in accordance with the needle drop position before the movement of the frame 5; then, the lower thread D is guided from the needle hole 19*a* to the guide hole 31 in response to the movement of the frame 5 to the first mid-point m1 (in the diagonally forward left direction).

FIG. 23(*b*) illustrates a state when the frame 5 has been moved almost to the second mid-point m2 (generally in the rightward direction) in the frame detouring movement control (two-time jump control) for the second area S2 performed at step St10. In this state, the upper thread T, extending downward from the rear portion of the eye hole 11*a* of the sewing needle 11 located at the upper position, is received by or caught on the restricting section 23*a* of the guide member in such a manner that right movement of the upper thread T beyond the up-and-down movement trajectory of the sewing needle 11 is restricted by the restricting section 23 and the upper thread T is entwined around the restricting section 23*a* in the counterclockwise direction. In response to the movement of the frame 5 from the first mid-point m1 to the second mid-point m2 (generally in the rightward direction), the lower thread D is bent upward by an edge of the guide hole 31 to enter the upper hollow space of the groove portion 32 and is then guided generally rightward along the groove portion 32.

FIG. 23(*c*) illustrates a state when the frame 5 has been moved almost to the target position T2 (generally in the diagonally rearward right direction) in the frame detouring movement control (two-time jump control) for the second area S2 performed at step St10. In this state, the upper thread T, extending downward from the rear portion of the eye hole 11*a* of the sewing needle 11 located at the upper position, has been entwined further around the restricting section 23*a* of the guide member 23 in the counterclockwise direction, as noted above. In response to the movement of the frame 5 from the second mid-point m2 to the target position T2 (generally in the diagonally rearward right direction), the lower thread D is received by the rear side wall 32*b* (near the needle hole 19*a*) of the groove portion 32 (see FIG. 10(*b*)) and held in front of the up-and-down movement trajectory of the sewing needle 11 without shifting rearward beyond the up-and-down movement trajectory of the sewing needle 11. This means that the path of the lower thread D pulled out upward from the rotary hook 3 to lead to the needle plate 19 is kept located in front of the up-and-down movement trajectory of the sewing needle 11.

With the frame 5 located at the target position T2, the sewing needle 11 descends further and then ascends, during the course of which a stitch is formed by the loop of the upper thread T twining around the lower thread D in response to the rotation of the rotary hook 3 as noted above. At this stage, the upper thread T having moved out from the rear portion of the eye hole 11*a* enters the rotary hook 3 with the upper thread T located to the left of the sewing needle 11 (entwined around the sewing needle 11 in the counterclockwise direction), and the path of the lower thread D pulled out of the lower thread bobbin to extend to the needle plate 19 is kept located in front of the up-and-down movement trajectory of the sewing needle 11. With such arrangements, it is possible to achieve desired sewing where occurrence of both a hitch stitch due to the behavior of the upper thread and a hitch stitch due to the behavior of the lower thread (i.e., double hitch stitches) is avoided.

Note that although the lower thread D is also pulled out in response to the detouring movement of the frame 5, slackness of the pulled-out lower thread D is absorbed promptly by the aforementioned spring action of the thread take-up member 41. Namely, in the present embodiment, even though the lower thread D is pulled out in response to the detouring movement of the frame 5, the spring action of the thread take-up member (thread take-up spring) 41 provided in the rotary hook 3 promptly absorbs slackness of the pulled-out lower thread D, and thus, the lower thread D can be kept in a taut state. Therefore, in the present embodiment, the lower thread D can be avoided from getting slackened to come off the receiving or engaging portion (groove portion 32) of the needle plate 19. Namely, in the present embodiment, the thread take-up member (thread take-up spring) 41 functions also as tension imparting means provided below the needle plate 19 for imparting tension to the lower thread pulled out upward from the rotary hook 3 to go toward the needle hole 19*a* or the guide hole 31 of the needle plate 19.

As well known in the art, the loop of the upper thread T captured by the hook point 61 of the outer rotary hook 60 passes through the inner rotary hook 50 and is then pulled by the thread take-up lever 10 (FIG. 4) upward along the lower thread D while reducing the size of the loop. Further, in the present embodiment, where the groove portion 32 is formed to have the bottom surface 32*a*, the loop of the upper thread T, passing upward through the needle hole 19*a* together with the lower thread D while reducing the size of the loop, without getting caught in the groove portion 32, so that an unwanted upper thread breakage can be avoided. Further, because the lower thread D is only received or engaged by the rear side wall 32*b* (FIG. 10(*b*)), the lower thread easily comes free from the groove portion 32 to return to the normal path (i.e., to the path along which the lower thread D passes through the needle hole 19*a*) when the sewing needle drops at the target position T2, as the lower thread D is pulled upward in response to the ascending movement of the upper thread T. Thus, no adverse influence is given to path formation of the lower thread D at the time of next stitch formation.

By performing the operations of steps St5, St9, and St10 in accordance with the needle moving direction (i.e., the next-stitch forming direction) of the stitch movement amount data Pn, the inventive arrangements achieve desired all-perfect-stitch sewing where occurrence of hitch stitches due to the behavior of the upper thread and due to the behavior of the lower thread (i.e., all types of hitch stitches) is avoided.

Now describing the remaining steps illustrated in FIG. 19, the program goes to step St6 after execution of the operations at step St5, St9, or step St10 and increments the value n of the stitch counter by one at step St6. At step St7, a determination is made as to whether or not the value n incremented by one at step St6 is greater than the "total number of stitches" of the pattern for which the sewing operation is being performed currently. With a NO determination at step St7, the program reverts to step St2 above to repeat the operations at and after step St2 for that incremented-by-one value n (i.e., for the next stitch). Once the sewing of the pattern for which the sewing operation is performed currently is completed, a YES determination is made at step St7, and thus the program of FIG. 19 is brought to an end.

<Setting of Frame Detour Control Data>

Figure 24:
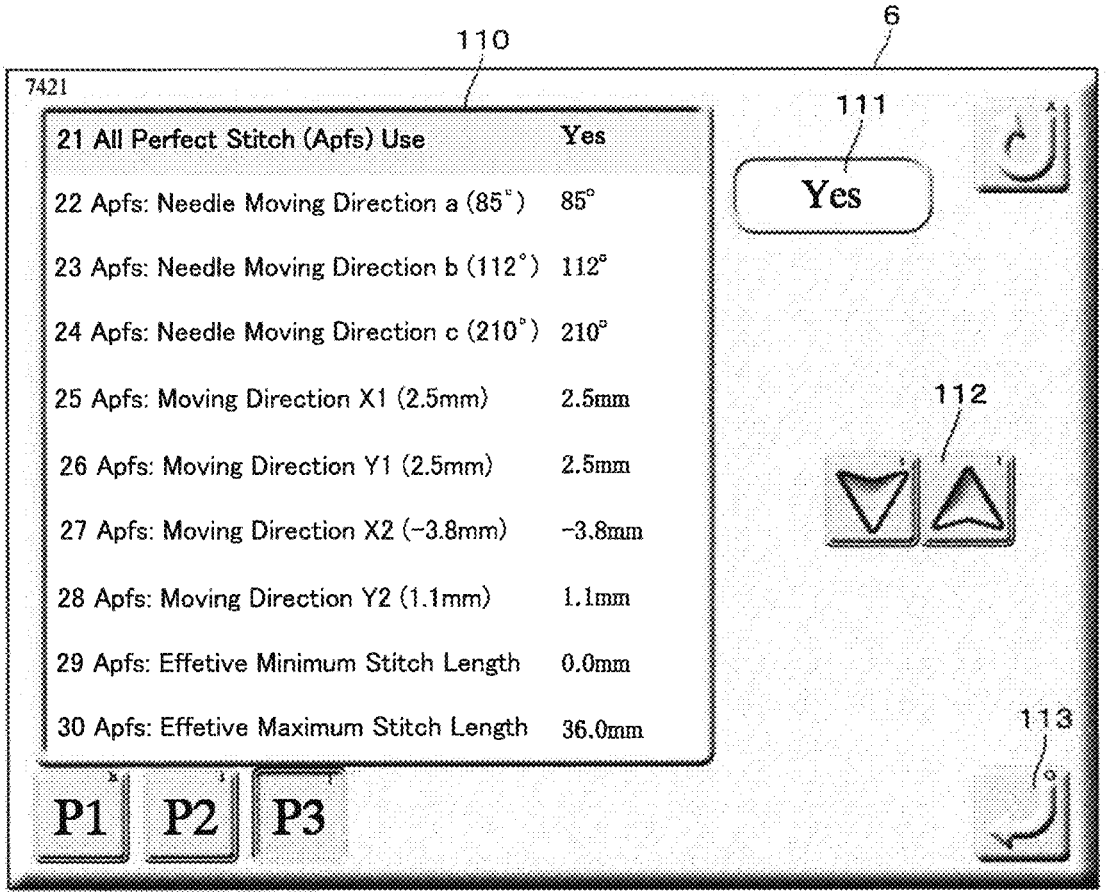
FIG. 24 is a diagram illustrating an example of settings of various frame-detour controlling data.

According to one embodiment, the inventive sewing machine may be constructed in such a manner that various data related to the frame detour control (i.e., various conditions for the detour control) can be set and changed or modified as desired by the user. FIG. 24 illustrates an example of a screen display via which various data related to the frame detour control (i.e., various conditions for the detour control) can be set and changed or modified as desired by use of the operation panel 6 (see FIG. 2). The operation panel 6 includes a touch-enabled display screen, and necessary images, data, and the like are displayed on the display screen in accordance with various operation modes. When the operation mode is a setting mode, a parameter setting screen 110 as illustrated in the figure is displayed on the display screen of the operation panel 6. As an example, setting items of Nos. 21 to 30 for the frame detour control are displayed with their respective current setting values. Alternatively, instead of the plurality of setting items of Nos. 21 to 30 being displayed simultaneously on the parameter setting screen 110, at least one of such setting items may be displayed on the screen 110 at a time, and the displayed setting item may be switched to another by a scroll operation or the like.

If the user touches and thereby selects a desired one of the setting items of Nos. 21 to 30 displayed on the parameter setting screen 110, the current setting value of the selected one setting item is displayed on a display section 111. By the user operating a setting value change key 112, the current setting value of the selected setting item can be changed to increase or decrease, and the thus-varied setting value is displayed on the display section 111. By the user depressing an ENTER key 113 after the change of the setting value, the changed setting value is made effective.

The setting item "All Perfect Stitch (Apfs) Use" of No. 21 corresponds to setting means for setting whether performing the frame detouring movement control should be made valid or not. Whether performing the frame detouring movement control should be made valid or not may be set, for example, by setting "Yes" or "No". The illustrated example denotes a state in which the setting item is set at "Yes". In an alternative, this setting value "Yes/No" may be replaced with "ON/OFF".

Figure 25:
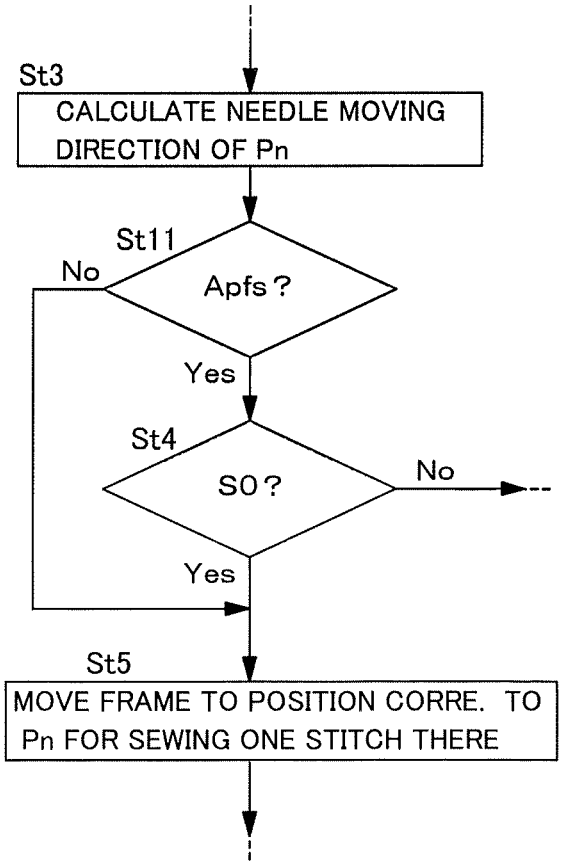
FIG. 25 is a flow chart illustrating a modification of the computer program illustrated in FIG. 19.

In order to actually control the validation/invalidation of the detouring movement control of the frame 5 in according with the setting of the No. 21 setting item, it is only necessary to modify a part of the flow of FIG. 19 as shown in FIG. 25. Namely, step St11 is inserted between steps St3 and St4, and a determination is made at this step St11 as to whether or not the setting item "All Perfect Stitch (Apfs) Use" is currently set at "YES" (i.e., as to whether performing the detouring movement control of the frame 5 is currently made valid or not). With a YES determination at step St11, the program goes to step St4 above, where the detouring movement control of the frame 5 is performed in the aforementioned manner. With a NO determination at step St11, however, the program jumps over step St4 to step St5; thus, in this case, the detouring movement control of the frame 5 is not performed.

By enabling such setting as to whether performing the frame detouring movement control should be made valid or not as noted above, the sewing operation can be performed in a variety of manners and with an enhanced efficiency. Although the inventive sewing machine can avoid occurrence of a hitch stitch due to the behavior of the upper thread and enhance the sewing quality by performing the detouring movement of the frame 5 as described above, an overall production efficiency of the sewing tends to inevitably decrease because extra time is required for the detouring movement of the frame 5. Depending on an intended or desired sewn product, it may sometime be more preferable to avoid a decrease of the production efficiency than to avoid degradation of the sewing quality resulting from occurrence of a hitch stitch. For example, in a case where a hidden part of a product invisible on the outer surface of the product is to be sewn, it may be considered to be more preferable to give priority to the production efficiency over the avoidance of occurrence of a hitch stitch. Further, the user may sometimes want to select whether or not to perform the detouring movement control of the frame 5, depending on a type of the sewing workpiece (fabric workpiece), a type of the upper thread, or the like. Furthermore, a degree of demand for avoiding occurrence of a hitch stitch may differ between simple straight sewing and complicated embroidery sewing. For these various possible cases, it is useful and beneficial to provide the function of selecting validation (Yes or ON) or invalidation (No or OFF) of the detouring movement of the frame 5.

The setting items of Nos. 22 to 24 are means for setting parameters a, b, and c prescribing a needle moving direction (stitch forming direction) for the frame detour control and more particularly correspond to setting means for variably setting respective ranges of the aforementioned first and second areas S1 and S2 (see FIG. 16). Boundary angles a and b that define the range of the first area S1 are variably set in accordance with setting of the items of Nos. 22 and 23. The boundary angle b of the angles b and c defining the range of the second area S2 is variably set in accordance with setting of the item of No. 23, and the boundary angle c is variably set in accordance with setting of the item of No. 24. As an example, predetermined values (for example, a=85°, b=112°, and c=210°) may be initially set in advance as the boundary angles a, b, and c; then, these initially set predetermined values a, b, and c may be increased or decreased, by user's manual operations, in such a manner that the thus-changed values are set as the boundary angles a, b, and c. Then, the determinations about the areas S0 and S1 at steps St4 and St8 of FIG. 19 are made on the basis of such variably-set values (i.e., values of the boundary angles a, b, and c).

Generally, it is difficult to precisely demarcate an area in which a hitch stitch is undesirably formed, and thus, to be on the safe side, it may be preferable to perform the frame detouring movement control after setting the areas S1 and S2, for which the frame detouring movement control is to be performed, to somewhat wider ranges. However, if the areas S1 and S2 are set to somewhat wider ranges like this, the overall production efficiency may undesirably decrease as the number of times the frame detouring movement control is performed increases. Further, depending on a desired or intended sewn product, there may arise a case in which the user desires to avoid a decrease of the production efficiency as much as possible by allowing or tolerating occurrence of a hitch stitch in sewing of a sewing workpiece portion for which it is not necessary to give high priority to the quality of stitches. Further, there may arise a case in which the user desires to variably set the ranges of the areas S1 and S2, for which the frame detour control is to be performed, in accordance with a type of the sewing workpiece (fabric workpiece), a type of the upper thread, or the like, without fixing the ranges of the areas S1 and S2. For these various possible cases, it is useful and beneficial to provide the function of variably setting the ranges of the predetermined areas S1 and S2 (values of the individual boundary angles a, b, and c) for which the detouring movement control of the frame 5 is to be performed.

The setting items of Nos. 25 and 26 are means for setting parameters X1 and Y1 that define a first moving direction in the frame detour control (i.e., setting means for variably setting a detouring path of the frame 5); more particularly, the setting items of Nos. 25 and 26 correspond to setting means for variably setting an X-Y displacement coordinate position of the first mid-point m1 (see FIG. 17) (i.e., a coordinate position relative to the base position C). The setting items of Nos. 27 and 28 are means for setting parameters X2 and Y2 that define a second moving direction in the frame detour control (i.e., setting means for variably setting a detouring path of the frame 5); more particularly, the setting items of Nos. 27 and 28 correspond to setting means for variably setting an X-Y displacement coordinate position (i.e., a coordinate position relative to the first mid-point m1) of the second mid-point m2 (see FIG. 17). For these parameters X1, Y1, X2, and Y2, too, predetermined values may be initially set in advance, and then these predetermined values may be increased or decreased, by response to user's manual operations, in such a manner that the thus-changed values are set as the parameters X1, Y1, X2, and Y2. Note that respective current values (2.5 mm, 2.5 mm, −3.8 mm, and 1.1 mm) of the parameters X1, Y1, X2, and Y2 illustrated in the figure are each denoted in an X-Y coordinate expression of stitches denoted in FIG. 1. For example, the X-Y displacement coordinate position of X1=2.5 mm and Y1=2.5 mm for defining the first mid-point m1 indicates a stitch position belonging to a quadrant of X+ and Y+ in the X-Y coordinate expression of stitches denoted in FIG. 1. Because the moving direction of the frame 5 corresponding to that stitch position is 180° opposite to the stitch position and hence belongs to a quadrant of X− and Y−, the moving direction of the frame 5 corresponds to the movement of the frame 5 from the base point C to the first mid-point m1 located to the left of and in front of the base point C in FIG. 17. Further, the X-Y displacement coordinate position of X2=−3.8 mm and Y2=1.1 mm for defining the second mid-point m2 indicates a stitch position belonging to a quadrant of X− and Y+ in the X-Y coordinate expression of stitches denoted in FIG. 1. Because the moving direction of the frame 5 corresponding to that stitch position is 180° opposite to the stitch position and hence belongs to a quadrant of X+ and Y−, the moving direction of the frame 5 corresponds to the movement of the frame 5 from the first mid-point m1 to the second mid-point m2 located to the right of and in front of the first mid-point m1 in FIG. 17. The detouring movement control of the frame 5 of steps St9 and St10 of FIG. 19 is performed on the basis of the settings set here (i.e., the set values of the parameters X1 and Y1 and the parameters X2 and Y2 respectively defining the first and second mid-points m1 and m2).

By enabling variable setting of the parameters X1, Y1, X2, and X2 defining the moving directions in the detour control of the frame 5 as described above, the detouring path of the frame 5 can be modified as necessary, If a relatively long detouring path of the frame 5 is set, for example, the upper thread can be reliably entwined around the guide member 23 of the presser foot device 21; however, because extra time is required for the detouring movement of the frame 5 in such a case, the overall production efficiency of the sewing decreases. If a relatively short detouring path of the frame 5 is set, on the other hand, the detouring movement of the frame 5 does not take much time, and thus, the overall production efficiency of the sewing can be enhanced. Therefore, the aforementioned setting means of the inventive sewing machine are useful and beneficial because they enable setting of an appropriate detouring path of the frame 5 in consideration of to which of the sewing quality and the production efficiency should be given priority.

Further, the setting items of Nos. 29 and 30 are means for setting an effective minimum stitch length and an effective maximum stitch length that are applied to the above-described frame detour control. The effective minimum stitch length is a minimum value of the stitch length that is applicable to the frame detour control, while the effective maximum stitch length is a maximum value of the stitch length that is applicable to the frame detour control. As an example, 0.0 mm is initially set as the effective minimum stitch length, and 36.0 mm is initially set as the effective maximum stitch length. By increasing or decreasing a desired one of these initially-set values as necessary, it is possible to set a user-desired effective minimum stitch length or maximum stitch length. In a case where such setting is to be applied to the frame detour control, the frame detour control may be performed if the length of a stitch to be formed next (next stitch length) is within a range between the set effective minimum stitch length and effective maximum stitch length. For example, a step of determining whether the length of the stitch to be formed next is within the range between the set effective minimum stitch length and effective maximum stitch length may be inserted between step St3 and step St4 of FIG. 19 (or between step St11 and step St4 of FIG. 25). With a YES determination at such a determination step, the program goes to step St4, while with a NO determination at such a determination step, the program jumps to step St5.

It should be noted that the construction (or configuration) for enabling the setting of various data related to the frame detour control (i.e., various conditions for the detour control) in the inventive sewing machine is not limited to the above-described construction or configuration where various data are set by user's manual operations via the operation panel 6 of the sewing machine as described above. Namely, an alternative construction may be employed such that at the time of making a desired sewing pattern program or embroidery pattern program, various data related to the frame detour control may be set as desired as detour controlling program data and prestored together with the sewing pattern program or embroidery pattern program. Such a construction in which the various data related to the frame detour control (i.e., conditions for the detour control) are supplied as such programmed data may also be employed in an embodiment of the setting means for variably setting the various data related to the frame detour control (conditions for the detour control).

Note that whereas the above-described embodiments are constructed in such a manner that when the detour control of the frame 5 is to be performed, the needle bar jump control by the jump mechanism is performed together with the frame detour control, the present invention is not so limited, and the present invention may also be practiced in a type of sewing machine that is not provided with the jump mechanism that performs the jump control of the needle bar. In order to perform the detour control of the frame 5 in such a sewing machine not provided with the jump mechanism, it is only necessary to control the operation of the needle bar in such a manner that the sewing needle does not drop during the detouring movement of the frame 5. For example, by reducing the rotation speed of the main shaft 13 during the detouring movement of the frame 5, the needle bar can be controlled in such a manner as to prevent the sewing needle from dropping during the detouring movement of the frame 5.

The embodiments of the present invention have been described above in relation to the case where the present invention is applied to a multi-head and multi-needle type sewing machine. However, the present invention should not be construed as being so limited, and the present invention may also be applied to a single-head type sewing machine or a single-needle type sewing machine. Furthermore, the present invention is applicable to both an embroidery sewing machine and an ordinary sewing machine. In addition, the holding member (or frame) for holding the sewing workpiece in the present invention is not limited to a flat plate type and may be a rotary type like a hat/cap frame. What is more, the rotary hook in the present invention is not limited to a full-rotation vertical rotary hook (DB type) and may be of any other desired type, such as a horizontal rotary hook or a half rotary hook. Furthermore, depending on the type, rotating direction and the like of the rotary hook employed, the areas in which a hitch stitch is undesirably formed may differ from the areas described above in relation to the embodiments of the present invention. In order to deal with such an area difference, it is only necessary to make appropriate modifications that may include making area determinations corresponding to the different areas, modifying the needle bar construction according to the different areas (for example, changing the positions of the guide hole 31 and the groove portion 32), or modifying the rotary rook construction (for example, changing the position of the recessed portion 52) according to the different areas.

What is more, the operation panel 6 employed in the present invention may be either mounted fixedly to the sewing machine or mounted removably to the sewing machine. As a modification, the above-described setting means (i.e., setting device) for manually setting various conditions for the detour control may be implemented by a portable-type operation panel (such as a mobile computer or a mobile terminal) constructed to enable manual setting of various conditions for the detour control as described above with reference to FIG. 24. In such a modification, the setting means (i.e., setting device) implemented by such a portable-type operation panel is provided with a communication function for enabling communication with the control device of the sewing machine and is constructed to enable transmission and receipt of setting information and data between the operation panel and the control device of the sewing machine. Needless to say, the inventive sewing machine may be constructed in such a manner that both of the operation panel 6 mounted fixedly or removably on the sewing machine and the portable-type operation panel can be used in combination as the setting means (i.e., setting device) for manually setting various conditions for the detour control.

The invention claimed is:

1. A rotary hook construction for a sewing machine, including a bobbin case rotatably housing a lower thread bobbin having the lower thread wound thereon, an inner rotary hook housing the bobbin case, and an outer rotary hook that rotates around the inner rotary hook in synchronism with an up-and-down movement of a sewing needle, the inner rotary hook having a needle drop hole formed in an upper front surface portion thereof, the outer rotary hook having a hook point member for capturing a loop of an upper thread, the rotary hook construction characterized in that the inner rotary hook has a recessed portion formed in the upper front surface portion and at a position deviated from the needle drop hole in a rotating direction of the outer rotary hook, the recessed portion opening forward and upward and downward and having a rear wall surface, and that the bobbin case has a thread take-up member provided thereon for directing the lower thread, paid out from the lower thread bobbin, toward the recessed portion of the inner rotary hook, wherein the lower thread paid out from the lower thread bobbin within the bobbin case is pulled out upward after passing through a hollow space of the recessed portion by way of the thread take-up member, and wherein rearward movement of the lower thread passing through the hollow space of the recessed portion is restricted by the rear wall surface of the recessed portion.

2. The rotary hook construction for a sewing machine according to claim 1, wherein the thread take-up member is provided beneath the recessed portion.

3. The rotary hook construction for a sewing machine according to claim 1, wherein the thread take-up member comprises a spring member.

4. The rotary hook construction for a sewing machine according to claim 1, wherein the thread take-up member has a free end and a fixed end, wherein the thread take-up member is fixed at the fixed end to the bobbin case, and wherein the thread take-up member has a ring portion of an annular or curved shape, at the free end, for passing therethrough the lower thread paid out from the lower thread bobbin.

5. The rotary hook construction for a sewing machine according to claim 1, wherein the outer rotary hook includes an upper spring member disposed around the hook point member, a front side edge of the upper spring member being formed so as not to project forward beyond a front side edge of the hook point member.

6. The rotary hook construction for a sewing machine according to claim 5, wherein the inner rotary hook includes a raised portion formed on a front outer peripheral surface of the inner rotary hook, the raised portion being provided over a range less than 90° from the recessed portion downstream in the rotating direction of the rotary hook.

7. The rotary hook construction for a sewing machine according to claim 5, wherein the recessed portion of the inner rotary hook has a rear wall surface that is located at a position, in front of a rotation trajectory of the front side edge of the hook point member of the outer rotary hook, near the rotation trajectory as much as possible.

8. The rotary hook construction for a sewing machine according to claim 1, wherein the bobbin case has a guide member provided in front of the thread take-up member, the guide member having a guide surface that is formed to connect generally continuously to a front surface of the bobbin case.

9. The rotary hook construction for a sewing machine according to claim 8, wherein the guide member has an opening formed in the guide surface so as to extend through the guide member in the front-rear direction.

10. A sewing machine comprising:

the rotary hook construction according to claim 1;

a sewing mechanism that performs sewing on a sewing workpiece by moving up and down the sewing needle with an upper thread passed therethrough and rotating the outer rotary hook in synchronism with the up-and-down movement of the sewing needle to thereby entwine the upper thread around the lower thread; and a feed mechanism that displaces a holding member, having the sewing workpiece held thereon, relative to a needle drop position, to thereby form a stitch in a desired direction on the sewing workpiece.

11. The sewing machine according to claim 10, further comprising:

determination means that determines whether or not a next-stitch forming direction belongs to a predetermined area in which a hitch stitch is undesirably formed; and detour control means that, upon determination that the next-stitch forming direction belongs to the predetermined area, moves the holding member via the feed mechanism so as to cause an upper thread extending downward from the sewing needle to detour in a direction corresponding to perfect stitch quality and then the holding member to move to a target position corresponding to the next stitch.

12. The sewing machine according to claim 11, further including a jump mechanism that, when jump control is to be performed during a sewing operation, holds the sewing needle at an upper position without causing the sewing needle to move down, wherein the detour control means controls the movement of the holding member via the feed mechanism while performing the jump control via the jump mechanism.

13. The rotary hook construction for a sewing machine according to claim 3, wherein the thread take-up member is configured to be swingable in response to movement of the lower thread passed through the ring portion.

* * * * *